US009334093B2

(12) United States Patent
Holley, Jr.

(10) Patent No.: US 9,334,093 B2
(45) Date of Patent: May 10, 2016

(54) CARTON WITH INSERT

(71) Applicant: GRAPHIC PACKAGING INTERNATIONAL, INC., Atlanta, GA (US)

(72) Inventor: John Murdick Holley, Jr., Lawrenceville, GA (US)

(73) Assignee: GRAPHIC PACKAGING INTERNATIONAL, INC., Atlanta, GA (US)

( * ) Notice: Subject to any disclaimer, the term of this patent is extended or adjusted under 35 U.S.C. 154(b) by 0 days.

(21) Appl. No.: 14/274,975

(22) Filed: May 12, 2014

(65) Prior Publication Data

US 2014/0332427 A1 Nov. 13, 2014

Related U.S. Application Data

(60) Provisional application No. 61/855,323, filed on May 13, 2013, provisional application No. 61/959,162, filed on Aug. 16, 2013, provisional application No. 61/963,653, filed on Dec. 10, 2013, provisional application No. 61/966,736, filed on Feb. 28, 2014.

(51) Int. Cl.
*B65D 71/38* (2006.01)
*B65D 5/44* (2006.01)
(Continued)

(52) U.S. Cl.
CPC ..... *B65D 71/38* (2013.01); *B65D 5/0281* (2013.01); *B65D 5/443* (2013.01); *B65D 5/445* (2013.01); *B65D 5/5009* (2013.01); *B65D 71/36* (2013.01); *B65B 5/024* (2013.01);
(Continued)

(58) Field of Classification Search
CPC ..... B65D 71/38; B65D 71/36; B65D 5/0281; B65D 5/443; B65D 5/5009; B65D 5/445
See application file for complete search history.

(56) References Cited

U.S. PATENT DOCUMENTS 1,925,102 A 9/1933 Levkoff
2,005,924 A 6/1935 Wilson
(Continued)

FOREIGN PATENT DOCUMENTS

CA 873185 6/1971
CA 2 610 666 5/2008
(Continued)

OTHER PUBLICATIONS

International Search Report and Written Opinion for PCT/US2014/037640 dated Sep. 12, 2014.
(Continued)

*Primary Examiner* — Andrew Perreault
(74) *Attorney, Agent, or Firm* — Womble Carlyle Sandridge & Rice, LLP

(57) ABSTRACT

A carton for holding a plurality of containers. The carton comprises a plurality of panels that extends at least partially around an interior of the carton. The plurality of panels can comprise a top panel and a side panel. An insert comprises a central panel and a crown retention panel foldably connected to the central panel. An attachment flap can be foldably connected to the crown retention panel. The top panel can at least partially overlap the central panel, at least a portion of the crown retention panel can be spaced apart from the side panel in the interior of the carton, and at least a portion of the attachment flap can be at least partially in face-to-face contact with the side panel.

44 Claims, 18 Drawing Sheets

(51) Int. Cl.

| | |
|---|---|
| ***B65D 5/54*** | (2006.01) |
| ***B65B 5/02*** | (2006.01) |
| ***B65D 5/50*** | (2006.01) |
| ***B65D 5/32*** | (2006.01) |
| ***B65D 5/468*** | (2006.01) |
| ***B65D 5/02*** | (2006.01) |
| ***B65D 71/36*** | (2006.01) |

(52) U.S. Cl.

CPC ..... *B65D 2571/0032* (2013.01); *B65D 2571/00141* (2013.01); *B65D 2571/00444* (2013.01); *B65D 2571/00574* (2013.01); *B65D 2571/00666* (2013.01); *B65D 2571/00728* (2013.01); *B65D 2571/00814* (2013.01)

(56) References Cited

U.S. PATENT DOCUMENTS

| | | | | |
|---|---|---|---|---|
| 2,067,749 | A | 1/1937 | Zimmerman et al. | |
| 2,115,673 | A | 4/1938 | Stompe | |
| 2,196,502 | A | 4/1940 | Kells | |
| 2,299,027 | A | 10/1942 | Novak | |
| 2,386,905 | A | 10/1945 | Meitzen | |
| 2,648,484 | A | 8/1953 | Belsinger | |
| 2,669,351 | A | 2/1954 | Carson et al. | |
| 2,754,047 | A | 7/1956 | Schmidt et al. | |
| 3,078,032 | A | 2/1963 | Robinson et al. | |
| 3,128,010 | A | 4/1964 | Forrer | |
| 3,133,634 | A | 5/1964 | Bozdar | |
| 3,173,596 | A | 3/1965 | Aust et al. | |
| 3,178,242 | A | 4/1965 | Ellis et al. | |
| 3,228,582 | A | 1/1966 | Osberg | |
| 3,263,861 | A | 8/1966 | Carr | |
| 3,265,283 | A | 8/1966 | Farquhar | |
| 3,300,115 | A | 1/1967 | Schauer | |
| 3,332,594 | A | 7/1967 | De Capua | |
| 3,346,167 | A | 10/1967 | Schmidt | |
| 3,356,279 | A | 12/1967 | Root | |
| 3,517,858 | A | 6/1970 | Farquhar | |
| 3,533,549 | A | 10/1970 | Gilchrist | |
| 3,540,581 | A | 11/1970 | Koolnis | |
| 3,825,170 | A | 7/1974 | Aust et al. | |
| 3,904,036 | A | 9/1975 | Forrer | |
| 4,155,449 | A | 5/1979 | Bryne | |
| 4,214,660 | A | 7/1980 | Hunt, Jr. | |
| 4,222,485 | A | 9/1980 | Focke | |
| 4,256,226 | A | 3/1981 | Stone | |
| 4,318,474 | A | 3/1982 | Hasegawa | |
| 4,364,509 | A | 12/1982 | Holley, Jr. et al. | |
| 4,375,258 | A | 3/1983 | Crayne et al. | |
| 4,376,509 | A | 3/1983 | Schaffer | |
| 4,378,877 | A | 4/1983 | Botterman et al. | |
| 4,396,143 | A | 8/1983 | Killy | |
| 4,417,655 | A | 11/1983 | Forbes, Jr. | |
| 4,417,661 | A | 11/1983 | Roccaforte | |
| 4,538,759 | A | 9/1985 | Dutcher | |
| 4,577,762 | A | 3/1986 | Kuchenbecker | |
| 4,588,084 | A | 5/1986 | Holley, Jr. | |
| 4,605,128 | A | 8/1986 | Rieke | |
| 4,621,766 | A | 11/1986 | McClure | |
| 4,658,984 | A | 4/1987 | Brunner | |
| 4,757,938 | A | 7/1988 | Collins | |
| 4,817,866 | A | 4/1989 | Wonnacott | |
| 4,830,267 | A | 5/1989 | Wilson | |
| 4,890,440 | A | 1/1990 | Romagnoli | |
| 4,949,845 | A | 8/1990 | Dixon | |
| 4,967,901 | A | 11/1990 | Wood | |
| 4,974,771 | A | 12/1990 | Lavery | |
| 5,072,876 | A | 12/1991 | Wilson | |
| 5,101,642 | A | 4/1992 | Alexandrov | |
| 5,119,985 | A | 6/1992 | Dawson et al. | |
| 5,137,211 | A | 8/1992 | Summer et al. | |
| 5,219,229 | A | 6/1993 | Sengewald | |
| 5,249,681 | A | 10/1993 | Miller | |
| 5,261,594 | A | 11/1993 | Brown et al. | |
| 5,297,725 | A | 3/1994 | Sutherland | |
| 5,320,277 | A | 6/1994 | Stout et al. | |
| 5,333,734 | A | 8/1994 | Stout et al. | |
| 5,350,109 | A | 9/1994 | Brown et al. | |
| 5,425,474 | A | 6/1995 | Dalea et al. | |
| 5,482,185 | A | 1/1996 | McNaughton | |
| 5,482,203 | A | 1/1996 | Stout | |
| 5,505,372 | A | 4/1996 | Edson et al. | |
| 5,577,612 | A | 11/1996 | Chesson et al. | |
| 5,588,585 | A | 12/1996 | McClure | |
| 5,597,114 | A | 1/1997 | Kramedjian et al. | |
| 5,622,309 | A | 4/1997 | Matsuda et al. | |
| 5,664,683 | A | 9/1997 | Brody | |
| 5,690,213 | A | 11/1997 | Matsumura | |
| 5,690,230 | A | 11/1997 | Griffith | |
| 5,794,778 | A | 8/1998 | Harris | |
| 5,826,783 | A | 10/1998 | Stout | |
| 5,873,516 | A | 2/1999 | Boggs | |
| 5,875,961 | A | 3/1999 | Stone et al. | |
| 5,881,884 | A | 3/1999 | Podosek | |
| 5,921,398 | A | 7/1999 | Carroll | |
| 5,924,559 | A | 7/1999 | Carrel et al. | |
| 5,927,498 | A | 7/1999 | Saam | |
| 6,050,402 | A | 4/2000 | Walter | |
| 6,149,009 | A | 11/2000 | Denola | |
| 6,170,741 | B1 | 1/2001 | Skolik et al. | |
| 6,176,419 | B1 | 1/2001 | Holley, Jr. | |
| 6,250,542 | B1 | 6/2001 | Negelen | |
| 6,283,293 | B1 | 9/2001 | Lingamfelter | |
| 6,302,320 | B1 | 10/2001 | Stout | |
| 6,409,077 | B1 | 6/2002 | Telesca et al. | |
| D459,927 | S | 7/2002 | Flowers et al. | |
| 6,471,120 | B1 | 10/2002 | Vogel | |
| 6,478,219 | B1 | 11/2002 | Holley, Jr. | |
| 6,484,903 | B2 | 11/2002 | Spivey et al. | |
| 6,550,615 | B2 | 4/2003 | Lingamfelter | |
| 6,557,699 | B1 | 5/2003 | Focke et al. | |
| 6,578,736 | B2 | 6/2003 | Spivey | |
| 6,604,677 | B1 | 8/2003 | Sutherland et al. | |
| 6,631,803 | B2 | 10/2003 | Rhodes et al. | |
| 6,669,083 | B2 | 12/2003 | Bates | |
| 6,715,639 | B2 | 4/2004 | Spivey | |
| 6,752,262 | B1 | 6/2004 | Boriani et al. | |
| 6,766,940 | B2 | 7/2004 | Negelen | |
| 6,789,673 | B2 | 9/2004 | Lingamfelter | |
| 6,848,573 | B2 | 2/2005 | Gould et al. | |
| 6,866,186 | B2 | 3/2005 | Fogle et al. | |
| 6,902,104 | B2 | 6/2005 | Holley, Jr. et al. | |
| 6,905,066 | B2 | 6/2005 | Holley, Jr. | |
| 6,918,487 | B2 | 7/2005 | Harrelson | |
| 6,926,193 | B2 | 8/2005 | Smalley | |
| 6,929,172 | B2 | 8/2005 | Bates et al. | |
| 6,932,265 | B2 | 8/2005 | Sax et al. | |
| 6,968,992 | B2 | 11/2005 | Schuster | |
| 6,969,172 | B2 | 11/2005 | Actis-Datta | |
| 6,974,072 | B2 | 12/2005 | Harrelson | |
| 6,991,107 | B2 | 1/2006 | Harrelson | |
| 6,997,316 | B2 | 2/2006 | Sutherland | |
| 7,000,803 | B2 | 2/2006 | Miller | |
| 7,073,665 | B2 | 7/2006 | Auclair et al. | |
| 7,104,435 | B2 | 9/2006 | Holley, Jr. | |
| 7,134,593 | B2 | 11/2006 | Harrelson | |
| 7,159,759 | B2 | 1/2007 | Sutherland et al. | |
| 7,225,930 | B2 | 6/2007 | Ford et al. | |
| 7,422,104 | B2 | 9/2008 | Perkinson | |
| 7,478,743 | B2 | 1/2009 | Holley, Jr. | |
| 7,604,157 | B2 | 10/2009 | Zammit et al. | |
| 7,699,163 | B2 * | 4/2010 | Gomes et al. | 206/162 |
| 7,699,215 | B2 | 4/2010 | Spivey, Sr. | |
| 8,356,743 | B2 | 1/2013 | Spivey, Sr. | |
| 8,387,855 | B2 | 3/2013 | Brand | |
| 8,439,194 | B2 * | 5/2013 | Spivey | 206/427 |
| 8,453,919 | B2 | 6/2013 | Eckermann | |
| 8,496,109 | B2 * | 7/2013 | Smalley et al. | 206/433 |
| 8,919,557 | B2 * | 12/2014 | Spivey, Sr. | 206/427 |
| 8,967,380 | B2 * | 3/2015 | Moncrief et al. | 206/427 |
| 2001/0017315 | A1 | 8/2001 | Baroudi | |
| 2002/0029991 | A1 | 3/2002 | Lingamfelter | |
| 2002/0070139 | A1 | 6/2002 | Bates | |

(56) References Cited

U.S. PATENT DOCUMENTS

| | | | | |
|---|---|---|---|---|
| 2002/0088820 | A1 | 7/2002 | Spivey | |
| 2002/0088821 | A1 | 7/2002 | Spivey et al. | |
| 2002/0185499 | A1 | 12/2002 | Harrelson et al. | |
| 2003/0006158 | A1 | 1/2003 | Skolik et al. | |
| 2003/0136820 | A1 | 7/2003 | Negelen | |
| 2003/0141313 | A1 | 7/2003 | Bates | |
| 2003/0150759 | A1 | 8/2003 | White, Jr. | |
| 2003/0192907 | A1 | 10/2003 | Bates | |
| 2004/0040334 | A1 | 3/2004 | Rusnock | |
| 2004/0060972 | A1 | 4/2004 | Harrelson | |
| 2004/0089575 | A1 | 5/2004 | Lingamfelter | |
| 2004/0089671 | A1 | 5/2004 | Miller | |
| 2004/0099558 | A1 | 5/2004 | Oliff et al. | |
| 2004/0155098 | A1 | 8/2004 | Harrelson | |
| 2004/0188277 | A1 | 9/2004 | Auclair | |
| 2004/0188300 | A1 | 9/2004 | Sutherland | |
| 2004/0188508 | A1 | 9/2004 | Holley, Jr. et al. | |
| 2005/0023170 | A1 | 2/2005 | Lingamfelter | |
| 2005/0092820 | A1 | 5/2005 | Chekroune | |
| 2005/0115843 | A1 | 6/2005 | Harrelson | |
| 2005/0126947 | A1 | 6/2005 | Holley, Jr. | |
| 2005/0167291 | A1 | 8/2005 | Sutherland | |
| 2005/0167478 | A1 | 8/2005 | Holley, Jr. | |
| 2005/0189405 | A1 | 9/2005 | Gomes et al. | |
| 2005/0263574 | A1 | 12/2005 | Schuster | |
| 2006/0054522 | A1 | 3/2006 | Kline et al. | |
| 2006/0081691 | A1 | 4/2006 | Smalley | |
| 2006/0091193 | A1 | 5/2006 | DeBusk | |
| 2006/0118606 | A1 | 6/2006 | Holley, Jr. et al. | |
| 2006/0131370 | A1 | 6/2006 | Bates | |
| 2006/0175386 | A1 | 8/2006 | Holley, Jr. | |
| 2006/0231441 | A1 | 10/2006 | Gomes | |
| 2006/0231600 | A1 | 10/2006 | Holley, Jr. | |
| 2006/0249413 | A1 | 11/2006 | Auclair et al. | |
| 2006/0278689 | A1 | 12/2006 | Boshinski et al. | |
| 2007/0007325 | A1 | 1/2007 | Suzuki et al. | |
| 2007/0029371 | A1 | 2/2007 | Theelen | |
| 2007/0108261 | A1 | 5/2007 | Schuster | |
| 2007/0131748 | A1 | 6/2007 | Brand | |
| 2007/0164093 | A1 | 7/2007 | Spivey et al. | |
| 2007/0181658 | A1 | 8/2007 | Sutherland | |
| 2007/0205255 | A1 | 9/2007 | Dunn | |
| 2007/0210144 | A1 | 9/2007 | Brand | |
| 2007/0251982 | A1 | 11/2007 | Brand | |
| 2007/0295790 | A1 | 12/2007 | Zammit et al. | |
| 2008/0023535 | A1 | 1/2008 | Holley, Jr. | |
| 2008/0048014 | A1 | 2/2008 | Bates | |
| 2008/0128479 | A1 | 6/2008 | Bates et al. | |
| 2008/0257944 | A1* | 10/2008 | Blin | 229/125.19 |
| 2009/0282843 | A1 | 11/2009 | Brand | |
| 2010/0044420 | A1 | 2/2010 | Brand et al. | |
| 2010/0122999 | A1 | 5/2010 | Brand | |
| 2010/0237138 | A1 | 9/2010 | Bradford | |
| 2011/0011924 | A1 | 1/2011 | Spivey et al. | |
| 2011/0049228 | A1 | 3/2011 | Brand | |
| 2011/0068160 | A1 | 3/2011 | Brand et al. | |
| 2011/0290692 | A1 | 12/2011 | Spivey, Sr. | |
| 2012/0091021 | A1* | 4/2012 | Smalley | 206/427 |
| 2013/0118942 | A1* | 5/2013 | Smalley et al. | 206/427 |
| 2013/0119122 | A1 | 5/2013 | Spivey, Sr. | |
| 2013/0277260 | A1 | 10/2013 | Smalley et al. | |
| 2013/0284628 | A1 | 10/2013 | Moncrief et al. | |

FOREIGN PATENT DOCUMENTS

| | | | |
|---|---|---|---|
| EP | 0 066 029 | | 12/1982 |
| EP | 1 433 714 | | 6/2004 |
| EP | 1 698 565 | | 9/2006 |
| FR | 2 549 010 | | 1/1985 |
| GB | 2 264 101 | | 8/1993 |
| JP | 2002-128064 | | 5/2002 |
| JP | 2005-255224 | A | 9/2005 |
| JP | 2006-111342 | | 4/2006 |
| JP | 2007-055630 | | 3/2007 |
| JP | 2007-532421 | | 11/2007 |
| JP | 2010-149927 | | 7/2010 |
| KR | 10-0154124 | | 2/1999 |
| KR | 10-0371048 | | 8/2003 |
| WO | WO 96/21603 | | 7/1996 |
| WO | WO 96/29260 | | 9/1996 |
| WO | WO 99/28198 | | 6/1999 |
| WO | WO 99/64301 | | 12/1999 |
| WO | WO 00/03937 | | 1/2000 |
| WO | WO 02/47990 | | 6/2002 |
| WO | WO 2004/043790 | | 5/2004 |
| WO | WO 2005/051781 | | 6/2005 |
| WO | WO 2005/100175 | | 10/2005 |
| WO | WO 2006/050210 | | 5/2006 |
| WO | WO 2006/050316 | | 5/2006 |
| WO | WO 2007/076544 | | 7/2007 |

OTHER PUBLICATIONS

International Search Report and Written Opinion for PCT/US2014/037655 dated Sep. 4, 2014.

International Search Report and Written Opinion for PCT/US2014/037656 dated Sep. 4, 2014.

International Search Report and Written Opinion for PCT/US2014/069472 dated Apr. 1, 2015.

International Search Report and Written Opinion for PCT/US2015/017959 dated Jun. 16, 2015.

* cited by examiner

CARTON WITH INSERT

CROSS-REFERENCE TO RELATED APPLICATIONS

This application claims the benefit of U.S. Provisional Patent Application No. 61/855,323, filed May 13, 2013, U.S. Provisional Patent Application No. 61/959,162, filed Aug. 16, 2013, U.S. Provisional Patent Application No. 61/963,653, filed Dec. 10, 2013, and U.S. Provisional Patent Application No. 61/966,736, filed Feb. 28, 2014.

INCORPORATION BY REFERENCE

The disclosures of U.S. Provisional Patent Application No. 61/855,323, which was filed on May 13, 2013, U.S. Provisional Patent Application No. 61/855,305, which was filed on May 13, 2013, U.S. Provisional Patent Application No. 61/959,162, which was filed on Aug. 16, 2013, U.S. Provisional Patent Application No. 61/963,653, which was filed on Dec. 10, 2013, U.S. Provisional Patent Application No. 61/966,736, which was filed on Feb. 28, 2014, U.S. patent application Ser. No. 13/419,740, which was filed on Mar. 14, 2012, U.S. patent application Ser. No. 13/768,079, which was filed on Feb. 15, 2013, and U.S. patent application Ser. No. 13/833,542, which was filed on Mar. 15, 2013, are hereby incorporated by reference for all purposes as if presented herein in their entirety.

BACKGROUND OF THE DISCLOSURE

The present disclosure generally relates to cartons for holding beverage containers or other types of articles. More specifically, the present disclosure relates to cartons having an article protection insert.

SUMMARY OF THE DISCLOSURE

In general, one aspect of the disclosure is directed to a carton for holding a plurality of containers. The carton comprises a plurality of panels that extends at least partially around an interior of the carton. The plurality of panels can comprise a top panel and a side panel. An insert comprises a central panel and a crown retention panel foldably connected to the central panel. An attachment flap can be foldably connected to the crown retention panel. The top panel can at least partially overlap the central panel, at least a portion of the crown retention panel can be spaced apart from the side panel in the interior of the carton, and at least a portion of the attachment flap can be at least partially in face-to-face contact with the side panel.

In another aspect, the disclosure is generally directed to, in combination, a carton blank and an insert for forming a carton for holding a plurality of containers. The carton blank comprises a plurality of panels comprising a top panel and a side panel, and the insert blank comprises a central panel and a crown retention panel foldably connected to the central panel. An attachment flap can be foldably connected to the crown retention panel. The top panel can at least partially overlap the central panel, at least a portion of the crown retention panel is for being disposed in a position that is spaced apart from the side panel when the carton is formed from the carton blank and the insert blank, and at least a portion of the attachment flap is for being disposed at least partially in face-to-face contact with the side panel when the carton is formed from the carton blank and the insert blank.

In another aspect, the disclosure is generally directed to a method of forming a carton for holding a plurality of containers. The method can comprise obtaining a carton blank comprising a plurality of panels comprising a top panel and a side panel and obtaining an insert blank comprising a central panel and a crown retention panel foldably connected to the central panel. An attachment flap can be foldably connected to the crown retention panel. The method further can include positioning the insert blank relative to the carton blank so that the top panel at least partially overlaps the central panel, folding the top panel relative to the side panel so that the central panel at least partially overlaps the side panel and the attachment flap is at least partially in face-to-face contact with the side panel, and forming an interior of the carton at least partially defined by the plurality of panels. The forming the interior of the carton can comprise forming an open-ended sleeve, and the forming the interior of the carton can cause the crown retention panel to fold relative to the central panel and to be disposed in a position that is spaced apart from the side panel in the interior of the carton.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "inner," "interior," "outer," "exterior," "lower," "bottom," "upper," and "top" indicate orientations determined in relation to fully erected and upright cartons.

Figure 1:
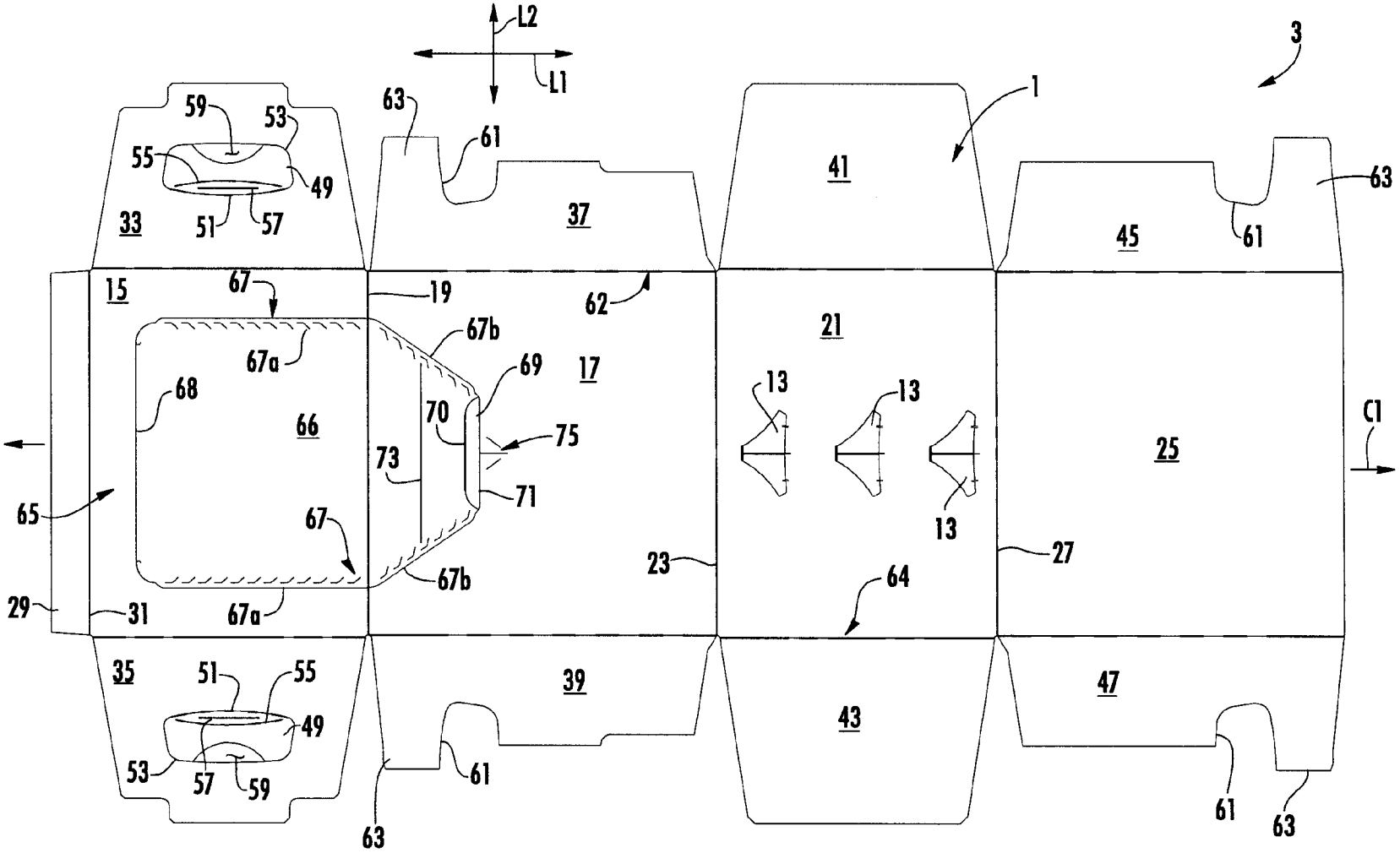
FIG. 1 is a plan view of a carton blank used to form a carton according to a first exemplary embodiment of the disclosure.

FIG. 1 is a plan view of the exterior side 1 of a blank, generally indicated at 3, used to form a carton 5 (FIG. 8) according to a first exemplary embodiment of the disclosure. The carton 5 can be used to house a plurality of articles such as containers C with necks or upper portions N that are generally narrower than the lower portions of the containers (FIG. 6). The containers C can include tops or caps CP (FIG. 6). In the illustrated embodiment, the carton 5 is sized to house twelve containers C in a single layer in a 3×4 arrangement, but it is understood that the carton 5 may be sized and shaped to hold containers of a different or same quantity in more than one layer and/or in different row/column arrangements (e.g., 1×6, 3×6, 2×6×2, 3×5, 4×5, 2×9, 2×6, 4×4, etc.). The carton 5 can include a dispenser 10 (FIGS. 8 and 9) for allowing access to the containers C. In the illustrated embodiment, the carton 5 includes first and second handles 11 (FIGS. 7-9) for grasping and carrying the carton at a respective first end 7 and second end 9 of the carton. As will be discussed below in more detail, the handles 11, are formed from various features in the blank 3. The carton 5 includes an insert 12 (FIGS. 5-7) that reinforces and strengthens the handles 11 and reinforces and stabilizes the containers C in the carton.

The blank 3 and carton 5 can have features that are similar or identical to the features described in any of the embodiments disclosed in the above-noted incorporated by reference patent applications, including U.S. patent application Ser. No. 13/419,740, and all related applications. Accordingly, in one embodiment, the carton 5 may have article protection flaps 13 for protecting the at least one article. As noted in the incorporated by reference applications, the article protection flaps 13 are moveable between a first position and a second position placed between adjacent containers C in the carton to reduce movement of the containers in the carton and prevent breakage of the containers. The carton 5 can have other features (e.g., article protection features in the ends 7, 9 of the carton 5 for cushioning one or more of the containers C) without departing from the disclosure.

The carton blank 3 has a longitudinal axis L1 and a lateral axis L2. The carton blank 3 can include a longitudinal centerline C1, as shown in FIG. 1. In the illustrated embodiment, the blank 3 comprises a top panel 15 foldably connected to a first side panel 17 at a first lateral fold line 19. A bottom panel 21 is foldably connected to the first side panel 17 at a second lateral fold line 23. A second side panel 25 is foldably connected to the bottom panel 21 at a third lateral fold line 27. In the illustrated embodiment, the blank 3 includes an attachment flap 29 foldably connected to the top panel 15 at a fourth lateral fold line 31. Any of the top and bottom panels 15, 21, the first and second side panels 17, 25, and the attachment flap 29 can be otherwise shaped, arranged, configured, or omitted, without departing from the disclosure. For example, the blank 3 can alternatively include two top panels cooperating to form a top of the carton 5 or two bottom panels cooperating to form a bottom of the carton. Additionally, the attachment flap 29 could be foldably connected to the second side panel 25 in an alternative embodiment.

The top panel 15 is foldably connected to a first top end flap 33 and a second top end flap 35. The first side panel 17 is foldably connected to a first side end flap 37 and a second side end flap 39. The bottom panel 21 is foldably connected to a first bottom end flap 41 and a second bottom end flap 43. The second side panel 25 is foldably connected to a first side end flap 45 and a second side end flap 47. When the carton 5 is erected, the top and bottom end flaps 33 and 41 and side end flaps 37 and 45 close the first end 7 of the carton, and the top and bottom end flaps 35 and 43 and side end flaps 39 and 47 close the second end 9 of the carton. In accordance with an alternative embodiment of the present disclosure, different flap arrangements can be used for at least partially closing the ends 7, 9 of the carton 5.

In one embodiment, the top and bottom end flaps 33 and 41 and side end flaps 37 and 45 extend along a first marginal area of the blank 3, and are foldably connected at a first longitudinal fold line 62 that extends along the length of the blank. In the illustrated embodiment, the top and bottom end flaps 35 and 43 and side end flaps 39 and 47 extend along a second marginal area of the blank 3, and are foldably connected at a second longitudinal fold line 64 that also extends along the length of the blank. The longitudinal fold lines 62, 64 may be, for example, substantially straight, or offset at one or more locations to account for blank thickness or for other factors.

As shown in FIG. 1, the features that form the handles 11 of the carton 5 include elongate handle flaps 49 formed in respective top end flaps 33, 35 and foldably attached to the respective top end flap at a respective arcuate fold line 51. The handle flaps 49 are separable from the respective top end flaps 33, 35 along a respective cut or tear line 53. An opposing arcuate fold line 55 can extend in each of the handle flaps 49 adjacent or proximate the respective arcuate fold lines 51, and a longitudinal score 57 can extend between the opposing arcuate fold lines 51, 55 in each of the handle flaps. In one embodiment, each of the handle flaps 49 can have an edge (e.g., a curved edge) that is adjacent a cutout 59. The features that form the handles 11 further include cutouts 61 in the respective side end flaps 37, 45, 39, 47. The side end flaps 37, 45, 39, 47 can also include respective upper portions 63 disposed above the respective cutouts 61. One of the handles 11 could have different features than the other handle or could be omitted without departing from the disclosure. One or both of the handles 11 could be otherwise shaped, arranged, and/or configured without departing from the disclosure. For example, one or both of the opposing arcuate fold lines 51, 55 in each handle 11 could be generally longitudinal.

According to the illustrated embodiment, the dispenser 10 comprises an outer dispenser pattern 65 including an outer dispenser panel 66, two outer tear lines 67, and a fold line 68 in the carton blank 3. The outer dispenser panel 66 is defined by the fold line 68 extending in the top panel 15 generally in the lateral L2 direction and the outer tear lines 67, which extend from the respective ends of the fold line 68 in the top panel 15 and into the first side panel 17. As shown in FIG. 1, each of the tear lines 67 can include a generally longitudinal portion 67*a* in at least the top panel 15 and an oblique portion 67*b* in at least the first side panel 17. In the illustrated embodiment, the outer dispenser pattern 65 can include an access panel 69 that is foldably connected to the outer dispenser panel 66 along a lateral fold line 70 and is separable from the outer dispenser panel 66 and the first side panel 17 along a tear or cut line 71. The outer dispenser panel 66 is separable from the top panel along the outer tear lines 67 to form a dispenser opening 72 (FIG. 9) to provide access to the containers C within the carton. The access panel 69 can help initiate tearing along the outer tear lines 67 by folding inwardly along the fold line 70 to form an access opening capable of receiving a hand, fingers, etc. so that a user can grip the outer dispenser panel 66 adjacent the access panel 69 and pull the outer dispenser panel 66 outwardly from the carton 5. As shown in FIG. 1, the outer dispenser pattern 65 can also include a lateral score 73 and cuts 75 that can also help with actuating the outer dispenser panel 66. The outer dispenser pattern 65 could be omitted or could be otherwise shaped, arranged, positioned and/or configured without departing from the disclosure.

In the illustrated embodiment, the bottom panel 21 includes three article protection flaps 13 foldably connected to the bottom panel and arranged in a single row generally located across the longitudinal centerline C1 of the bottom panel. The article protection flaps can be similar to, or the same as, those described in U.S. patent application Ser. No. 13/419,740, filed Mar. 14, 2012, the disclosure of which is hereby incorporated by reference for all purposes as if presented herein in its entirety. The article protection flaps 13 could be omitted or could be otherwise shaped, arranged, positioned, and/or configured without departing from the disclosure.

Figure 2:
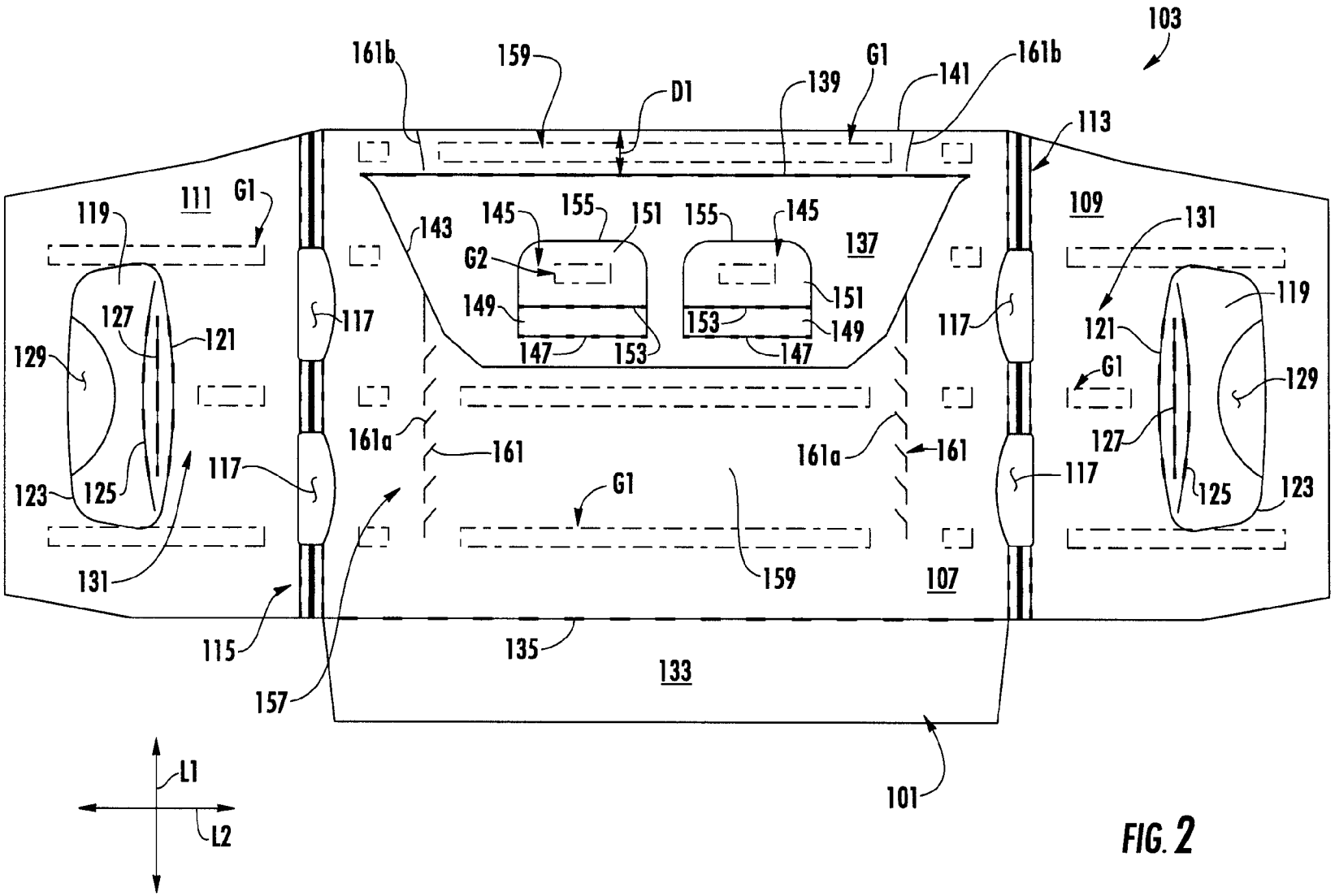
FIG. 2 is a plan view of an insert blank for forming an insert according to the first exemplary embodiment of the disclosure.
Figure 3:
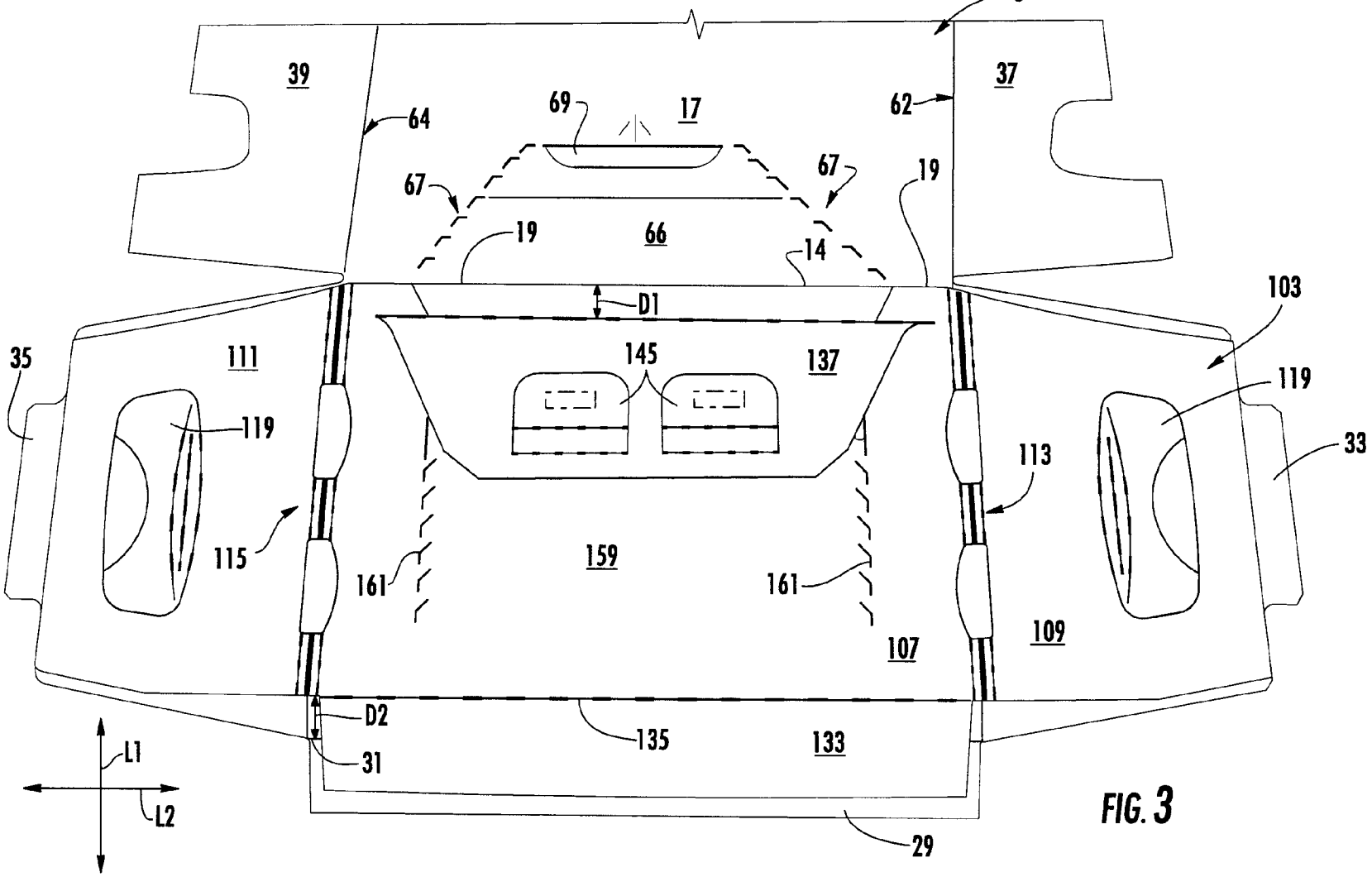
FIG. 3 is a plan view of the insert blank disposed on the carton blank according to the first exemplary embodiment of the disclosure.

FIG. 2 illustrates an interior surface 101 of an insert blank 103 used to form the insert 12 (FIGS. 5-7) for use in the carton 5 according to the exemplary embodiment of the disclosure. As illustrated in FIGS. 2 and 3, the longitudinal axis L1 and the lateral axis L2 of the insert blank 103 are oriented so that the longitudinal axis L1 and the lateral axis L2 of the insert blank 103 comport with the respective longitudinal axis L1 and lateral axis L2 of the carton blank 3 established in FIG. 1. In the illustrated embodiment, the insert blank 103 includes a central panel 107 and two inner end flaps 109, 111 respectively foldably connected to the central panel 107 at opposite ends of the central panel. A first fold line or area 113 connects the first inner end flap 109 to the central panel 107 at the first end of the insert blank 103, and a second fold line or area 115 connects the second inner end flap 111 to the central panel 107 at the second end of the insert blank 103. In the illustrated embodiment, each of the fold areas 113, 115 can include several fold lines (e.g., scores, creases, cut-crease lines, etc.). Alternatively, the fold areas 113, 115 can be other lines or areas of weakening for folding the reinforcing end panels 109, 111 relative to the central panel 107 (e.g., a single fold line). Openings 117 can interrupt the fold areas 113, 115 to help avoid bunching of the insert blank material at the folds of the insert 105 in the erected carton 5.

In the illustrated embodiment, the insert blank 103 includes features for forming the handles 11 in the carton 5. Each of the reinforcing end flaps 109, 111 can include an inner handle flap 119 foldably attached to the respective inner end flap at a respective arcuate fold line 121. The inner handle flaps 119 are separable from the respective inner end flaps 109, 111 along a respective cut or tear line 123. An opposing arcuate fold line 125 can extend in each of the inner handle flaps 119 adjacent or proximate the respective arcuate fold lines 121, and a longitudinal fold line 127 can extend between the opposing arcuate fold lines 121, 125 in each of the inner handle flaps. In one embodiment, each of the inner handle flaps 119 can have an edge (e.g., a curved edge) that is adjacent a cutout 129. An upper portion 131 can be disposed above each of the inner handle flaps 119 in each of the reinforcing end flaps 109, 111. The inner handle flaps 119, the fold lines 121, 125, 127, and the cutouts 129 can be similar or identical to the respective outer handle flaps 49, fold lines 51, 55, 57, and cutouts 59 so that the inner and outer handle flaps, fold lines, and cutouts are generally aligned and/or are overlapped with respect to one another in the handles 11 in the erected carton 5. The inner handle flaps 119, the fold lines 121, 125, 127, the cutouts 129, the outer handle flaps 49, the fold lines 51, 55, 57, and/or the cutouts 59 could be otherwise shaped, arranged, and/or configured without departing from the disclosure. For example, one or both of the opposing arcuate fold lines 121, 125 in each of the inner handle flaps 119 could be generally longitudinal.

In the illustrated embodiment, the insert blank 103 includes a side flap 133 foldably connected to the central panel 107 at a lateral fold line 135. In one embodiment, an inner side panel or crown retention panel 137 can be included in the central panel 107. As shown in FIG. 2, the crown retention panel 137 is foldably connected to the central panel 107 along a lateral fold line 139 that is spaced apart from a free edge 141 of the insert blank 103 by a distance D1. The crown retention panel 137 can be separable from the central panel 107 along a tear or cut line 143. In the illustrated embodiment, the crown retention panel 137 includes two attachment flaps 145 foldably connected to the crown retention panel 137 along lateral fold lines 147. Each of the attachment flaps 145 can include a proximal portion 149 foldably connected to a distal portion 151 along a lateral fold line 153 so that the proximal portion 149 can be independently positioned with respect to the distal portion 151. In one embodiment, each of the attachment flaps 145 can be separable from the crown retention panel 137 along a respective tear or cut line 155 (e.g., a U-shaped cut line). The side flap 133, the crown retention panel 137, and/or the attachment flaps 145 could be otherwise shaped, arranged, and/or configured without departing from the disclosure. For example, the crown retention panel 137 could include any suitable number of attachment flaps 145 (e.g., one or more than two attachment flaps). Additionally, one or both of the attachment flaps 145 and/or the crown retention panel 137 could be rotated with respect to the orientation shown in FIG. 2.

Figure 9:
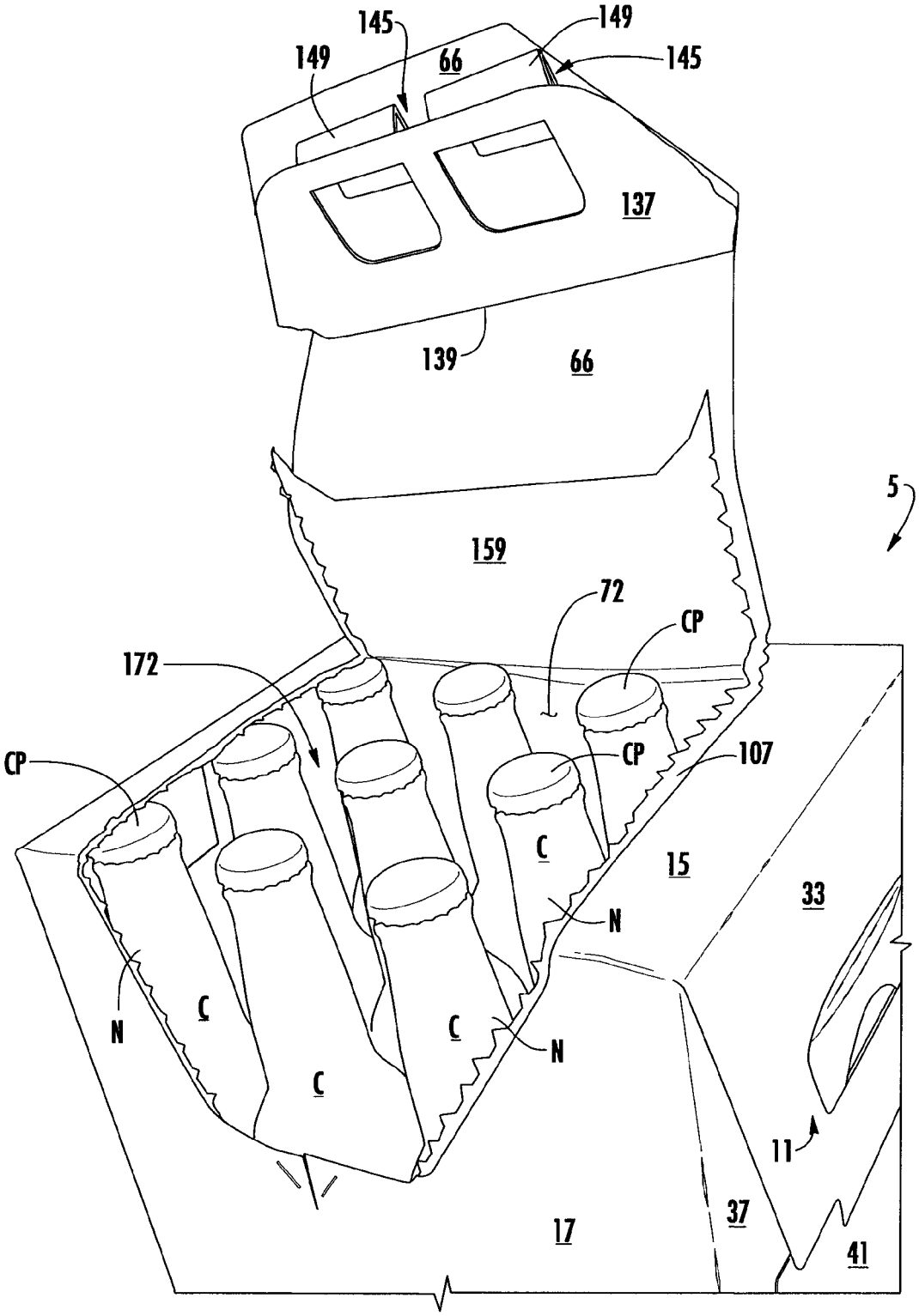
FIG. 9 is a perspective view of the carton of FIG. 8 with an actuated dispenser according to the first exemplary embodiment of the disclosure.

As shown in FIG. 2, the insert blank 103 can include an inner dispenser pattern 157 including an inner dispenser portion 159 (e.g., an inner dispenser panel) at least partially defined by inner tear lines 161. Each of the inner tear lines 161 can include a first portion 161*a* extending from the cut or tear line 143 towards the fold line 135 and a second portion 161*b* extending from the free edge 141 of the insert blank 103 to the fold line 139. The inner dispenser portion 159 is configured to be aligned with the outer dispenser panel 66 of the top panel 15 of the carton blank 3. In one embodiment, the inner dispenser panel 159 can include at least a portion of the crown retention panel 137. For example, the crown retention panel 137 can be pivoted upwardly with the dispenser panels 66, 159 when the dispenser is actuated as shown in FIG. 9. The inner dispenser pattern 157 could be otherwise shaped, arranged, positioned, and/or configured without departing from the disclosure.

Figure 4:
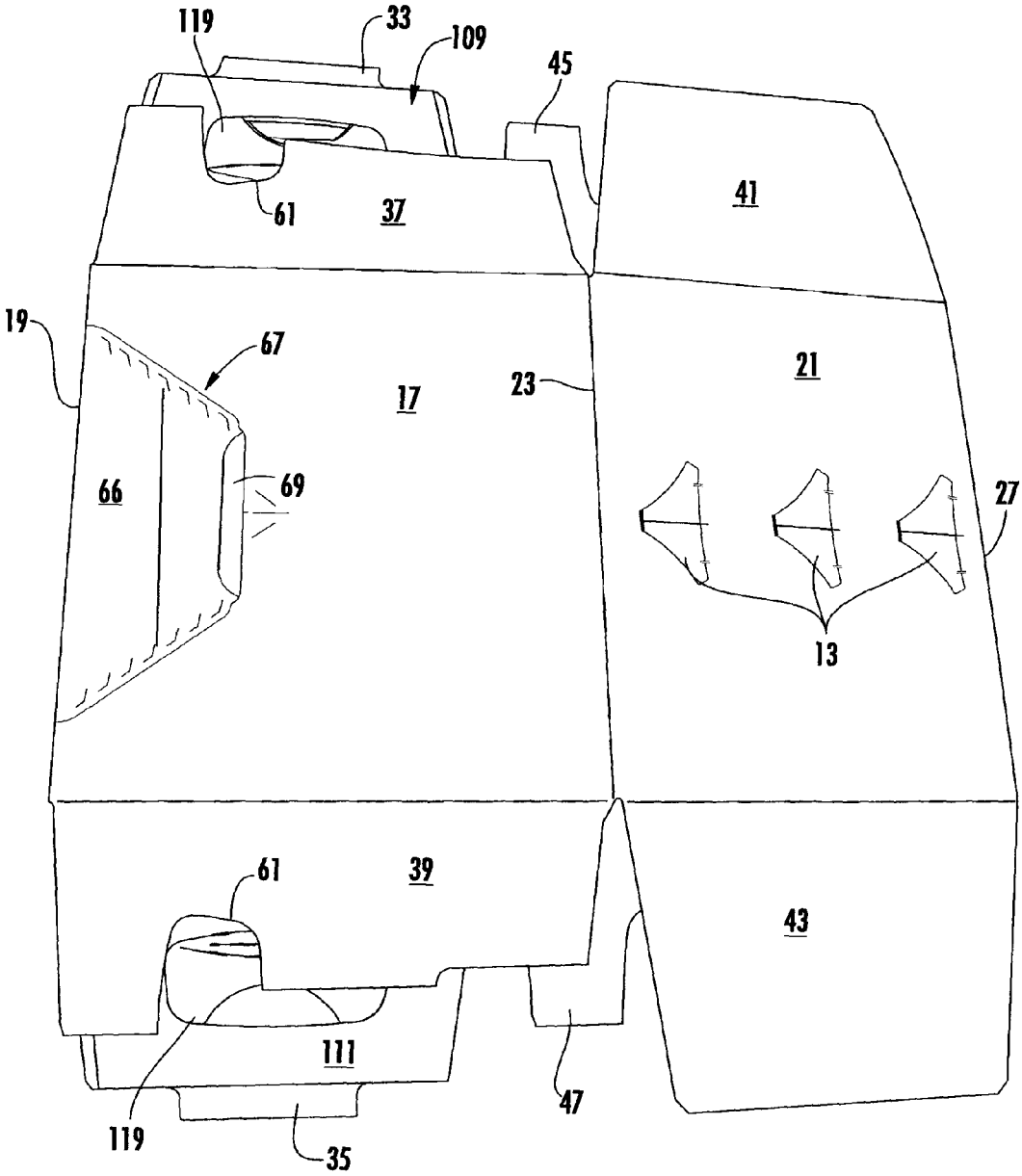
FIGS. 4 and 5 are perspective views of a partially-erected carton according to the first exemplary embodiment of the disclosure.
Figure 5:
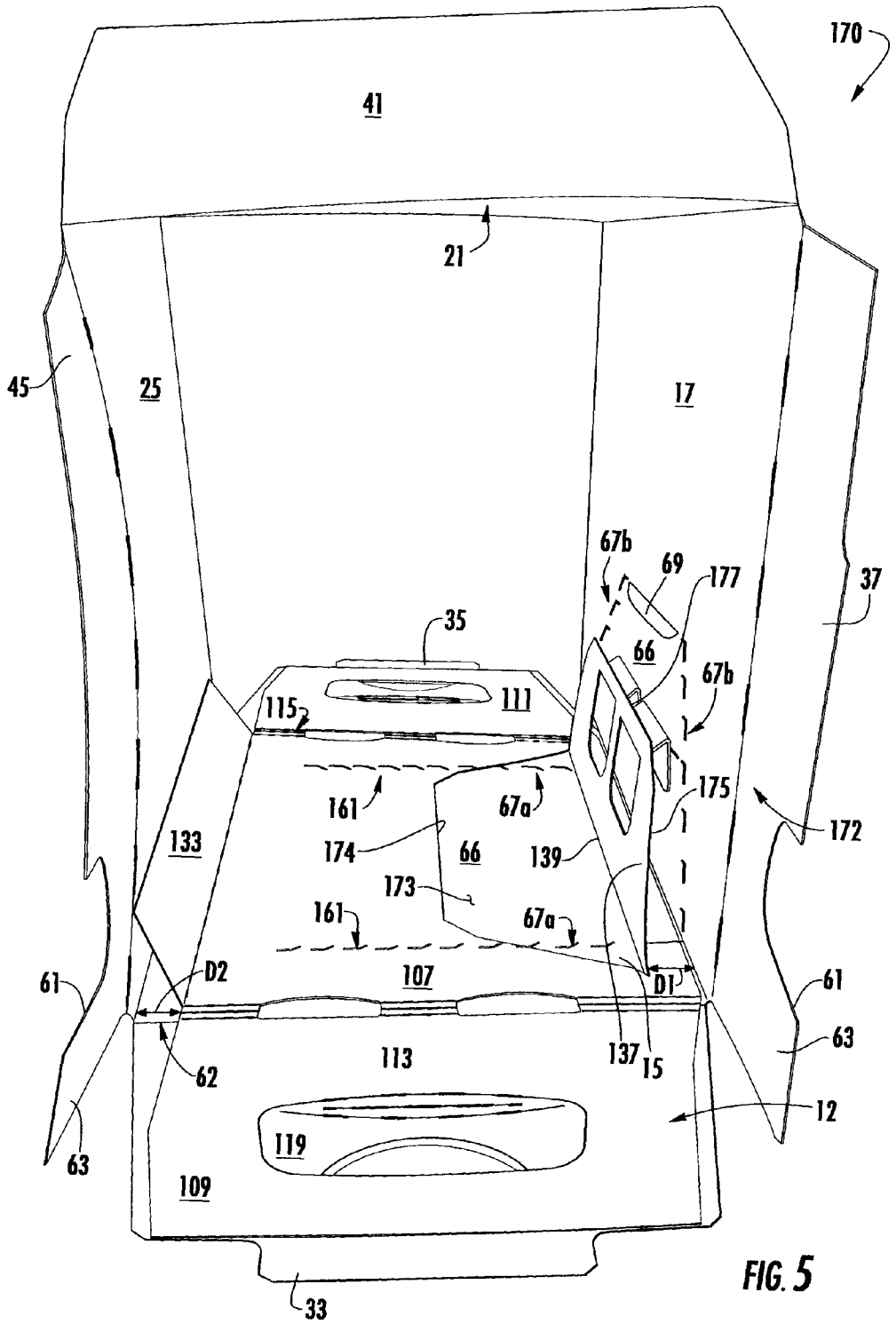
Figure 6:
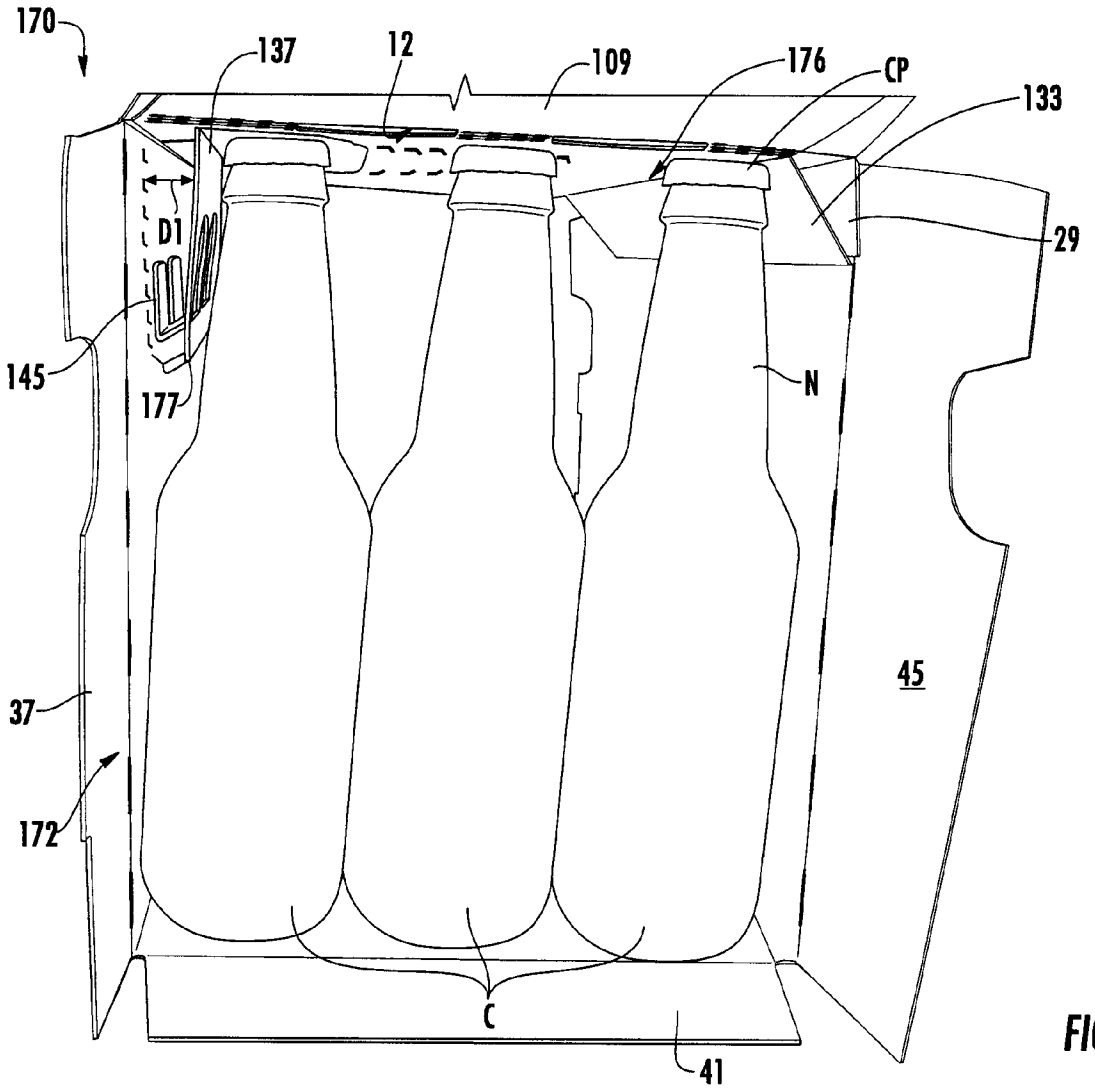
FIG. 6 is a perspective view of the partially-erected carton of FIG. 5 with containers loaded therein according to the first exemplary embodiment of the disclosure.

As shown in FIGS. 3-5, in one exemplary embodiment, the carton 5 can be assembled by initially adhering the insert blank 103 to the top panel 15 and the top flaps 33, 35 of the carton blank 3. In the illustrated embodiment, the insert blank 103 can be positioned on the interior surface of the carton blank 3 so that the central panel 107 is at least partially in face-to-face contact with the top panel 15 and the inner end flaps 109, 111 are at least partially in face-to-face contact with the respective top end flaps 33, 35 with the fold areas 113, 115 generally aligned with the respective longitudinal fold lines 62, 64 (FIG. 3). In the illustrated embodiment, the insert blank 103 can be positioned so that the lateral fold line 135 connecting the side flap 133 to the central panel 107 is spaced apart from the lateral fold line 31 connecting the top panel 15 to the attachment flap 29 by at least a distance D2 (FIG. 3) and the lateral fold line 139 connecting the crown retention panel 137 to the central panel 107 is spaced apart from the lateral fold line 19 and the first side panel 17 by at least the distance D1 (FIGS. 2 and 3). The insert blank 103 could be otherwise positioned on the carton blank 3 without departing from the scope of this disclosure.

In the illustrated embodiment, the central panel 107 can be glued to the interior surface of the top panel 15, and the inner end flaps 109, 111 can be glued to the respective top end flaps 33, 35, such as by glue strips (e.g., glue strips G1 shown in FIG. 2). In one embodiment, the crown retention panel 137 is not glued to the top panel 15 and the side flap 133 is not glued to the top panel 15 or the attachment flap 29 so that the crown retention panel and the side flap can be positioned independently of the side panels, the attachment flap, and the top panel. In the illustrated embodiment, when the insert blank 103 is glued to the carton blank 3, the outer handle flaps 49 at least partially overlap and/or are generally aligned with the inner handle flaps 119.

As shown in FIG. 4, the carton blank 103 can be folded along the lateral fold lines 19 and 27 so that the first side panel 17 generally overlaps the top panel 15 and the central panel 107 and so that the second side panel 25 generally overlaps the attachment flap 29. The attachment flap 29 can be glued to the interior surface of the second side panel 25, such as by a glue strip. Similarly, the attachment flaps 145 of the crown retention panel 137 can be glued to the first side panel 17, such as by respective glue strips (e.g., glue strips G2 shown in FIGS. 2 and 3). In one embodiment, the attachment flaps 145 can be glued to the portion of the dispenser panel 66 that extends in the first side panel 17.

In accordance with the exemplary embodiment, the carton blank 3 with insert blank 103 can be further erected into the carton 5 by folding along fold lines 19, 23, 27, and 31 to form an open-ended sleeve 170 with an interior 172 (FIG. 5). Containers C can be loaded into the interior 172 of the open-ended sleeve 170 (FIG. 6). In one embodiment, the containers C could be loaded before or after closing either or both of the ends 7, 9 of the carton. The sleeve 170 could be otherwise formed without departing from the scope of this disclosure.

In the illustrated embodiment, as the open-ended sleeve 170 is formed, the insert blank 103 is formed into the insert 12. Accordingly, as the outer side panels 17, 25 are folded with respect to the top panel 15 (e.g., so that the side panels 17, 25 are generally vertical and the top panel 15 is generally horizontal), the crown retention panel 137 can at least partially separate from the central panel 107 to extend at least partially into the interior 172 of the open-ended sleeve 170, generally parallel to the first side panel 17. As shown in FIGS. 5 and 6, the crown retention panel 137 can fold along the lateral fold line 139 and the lateral fold lines 147, 153 so that the crown retention panel 137 is at least partially spaced apart from the second side panel 17 by the distance D1 (FIGS. 5 and 6) into the interior 172 of the sleeve 170. In the illustrated embodiment, as the crown retention panel 137 separates from the central panel 107 along cut line 143, an opening 173 (FIG. 5) is formed in the central panel 107. An interior edge 174 of the central panel 107 extends adjacent to the opening 173, and the top panel 15 can be visible through the opening 173. The cut line 143 also forms an outer edge 175 of the crown retention panel 137. The outer edge 175 can have a lowermost portion 177 (e.g., lowermost edge) as shown in FIGS. 5 and 6. In one embodiment, the attachment flaps 145 separate from the crown retention flap 137 along the respective cut lines 155 and remain attached to the first side panel 17 (FIGS. 5 and 6) to help stabilize the lower portion of the crown retention panel 137.

As shown in FIGS. 5 and 6, the side flap 133 can fold along the lateral fold line 135, which is spaced apart from the second side panel 25 by the distance D2 (FIG. 5). Accordingly, the side flap 133 can extend obliquely between the top panel 15 and the second side panel 25 in the interior 172 of the carton. As shown in FIG. 6, the crown retention panel 137 and the inner side flap 133 can contact the upper portions N and/or caps CP of the containers C that are adjacent the respective side panels 17, 25 to help restrain the narrower upper portions N of the containers. The crown retention panel 137 and the inner side flap 133 could be otherwise shaped, arranged, and/or configured without departing from the disclosure.

Figure 7:
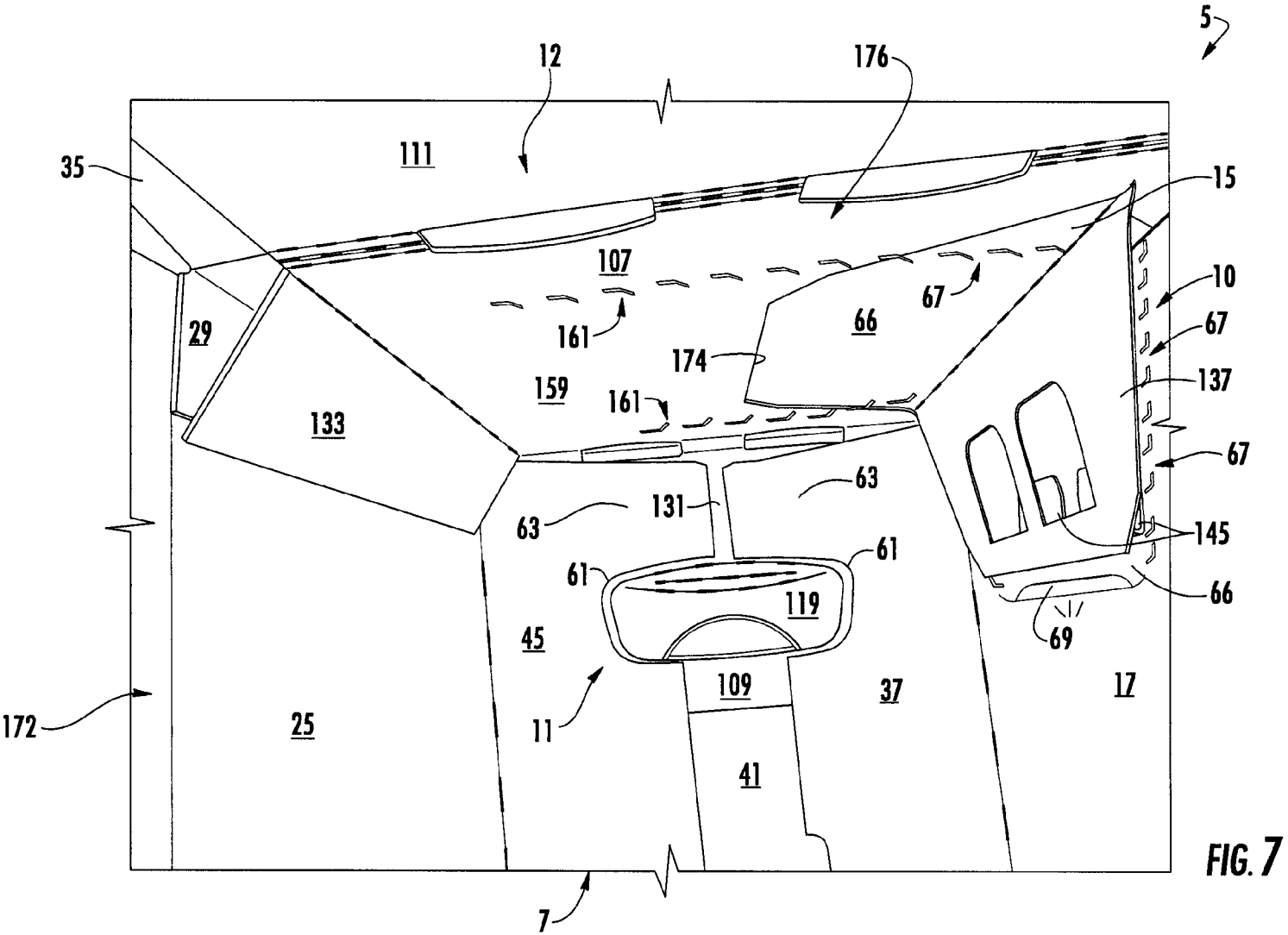
FIG. 7 is a perspective view of a closed end in the interior of the carton according to the first exemplary embodiment of the disclosure.
Figure 8:
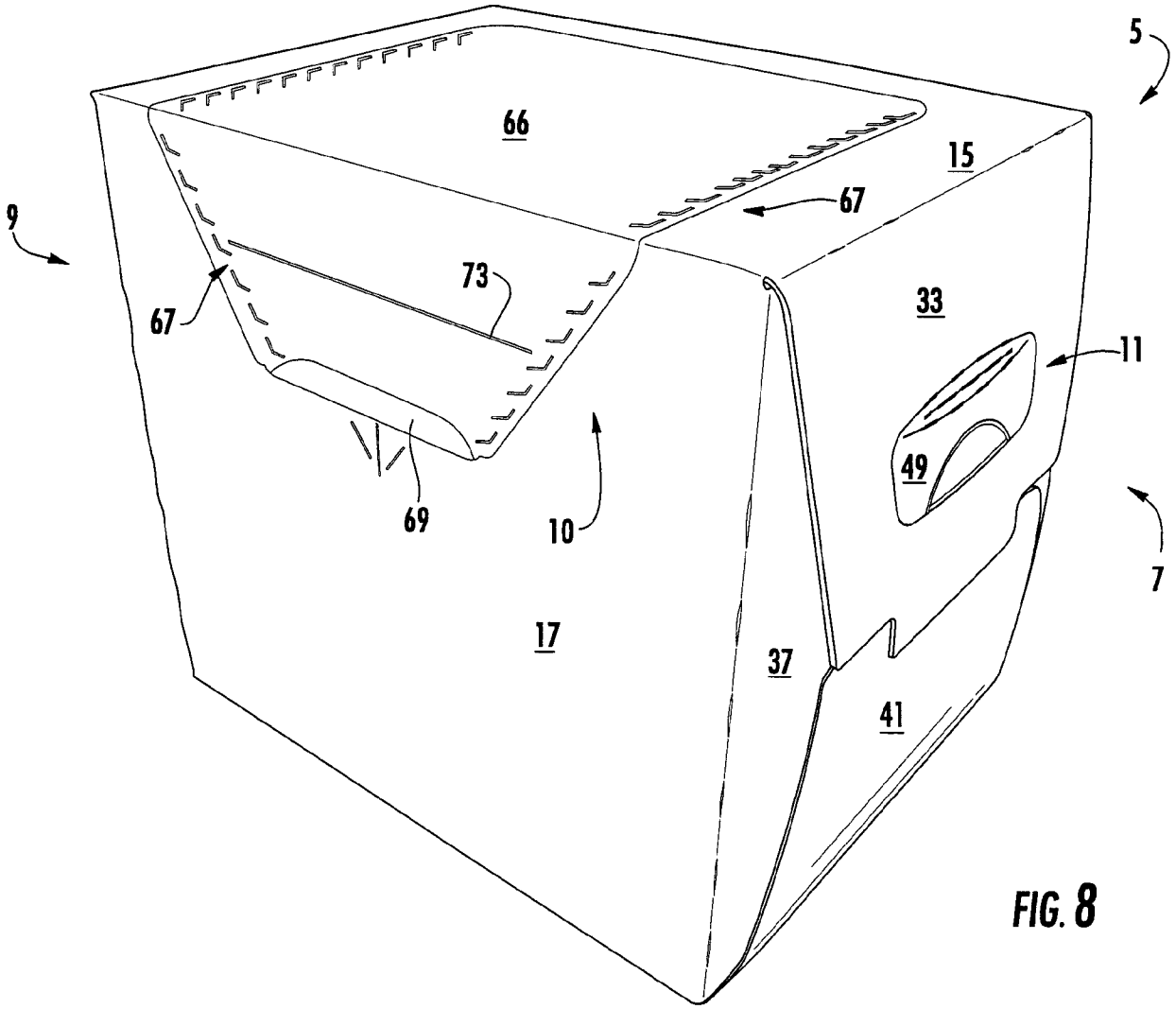
FIG. 8 is a perspective view of the erected carton according to the first exemplary embodiment of the disclosure.

In one embodiment, the ends 7, 9 of the carton 5 can be closed as shown in FIGS. 7 and 8. The side end flaps 37, 45 can be inwardly folded to at least partially close the first end 7. In the exemplary embodiment, the top end flap 33 and the reinforcing end flap 109 can be downwardly folded and the bottom end flap 41 can be upwardly folded to overlap the side end flaps 37, 45 and to further at least partially close the first end 7. When the top end flap 33 and the inner end flap 109 overlap the side end flaps 37, 45, the inner and outer handle flaps 119, 49 are generally aligned with the cutouts 61 in the side end flaps to form the handle 11. Accordingly, a user can grasp the carton 5 at the handle 11 by folding the handle flaps 49, 119 into the interior 172 of the carton to form a handle opening (not shown). In the illustrated embodiment, the second end 9 can be closed in a similar or identical manner as the first end 7, and the handle 11 in the second end 9 can be formed in a similar manner as the handle 11 in the first end 7. The first end 7 and/or the second end 9 could be closed by other steps without departing from the disclosure. Further, the handles 11 could be formed by other steps without departing from the disclosure.

The erected carton 5 according to the exemplary embodiment is shown in FIG. 8. In the exemplary embodiment, the crown retention panel 137, the inner side flap 133, and/or other features can help provide an upper portion or crown area 176 (FIGS. 5-7) of the carton 5 that is smaller than the lower portion of the carton to help restrain the narrower upper portions N of the containers C. In one embodiment, the article protection flaps 13 in the bottom panel 21 also help restrain movement of the containers C.

In the illustrated embodiment, a user can grasp and carry the carton 5 at the handles 11 by folding the outer handle flaps 49 and the inner handle flaps 119 into the interior 172 of the carton to form handle openings (not shown) in the ends 7, 9 of the carton. The dispenser 10 can be can be opened by tearing the dispenser panel 66 away along the tear lines 67 to form a dispenser opening (not shown) in the top panel 15 and the side panel 17 of the carton 5. The tearing of the dispenser panel can be initiated, for example, at the access panel 69. In one embodiment, as shown by way of example in FIG. 9, the dispenser portion 159 of the central panel 107 of the insert 12 defined between the tear lines 161 can be glued to the portion of the dispenser panel 66 in the top panel 15. Accordingly, when the dispenser panel 66 is torn away, the central panel 107 can tear along the tear lines 161 and the crown retention panel 137, which can be attached to the dispenser panel 66 via the attachment flaps 145, can be pulled out of the interior of the carton to help provide access to the containers C. The handles 11 and/or the dispenser panel 10 could be otherwise actuated without departing from the disclosure.

Figure 10:
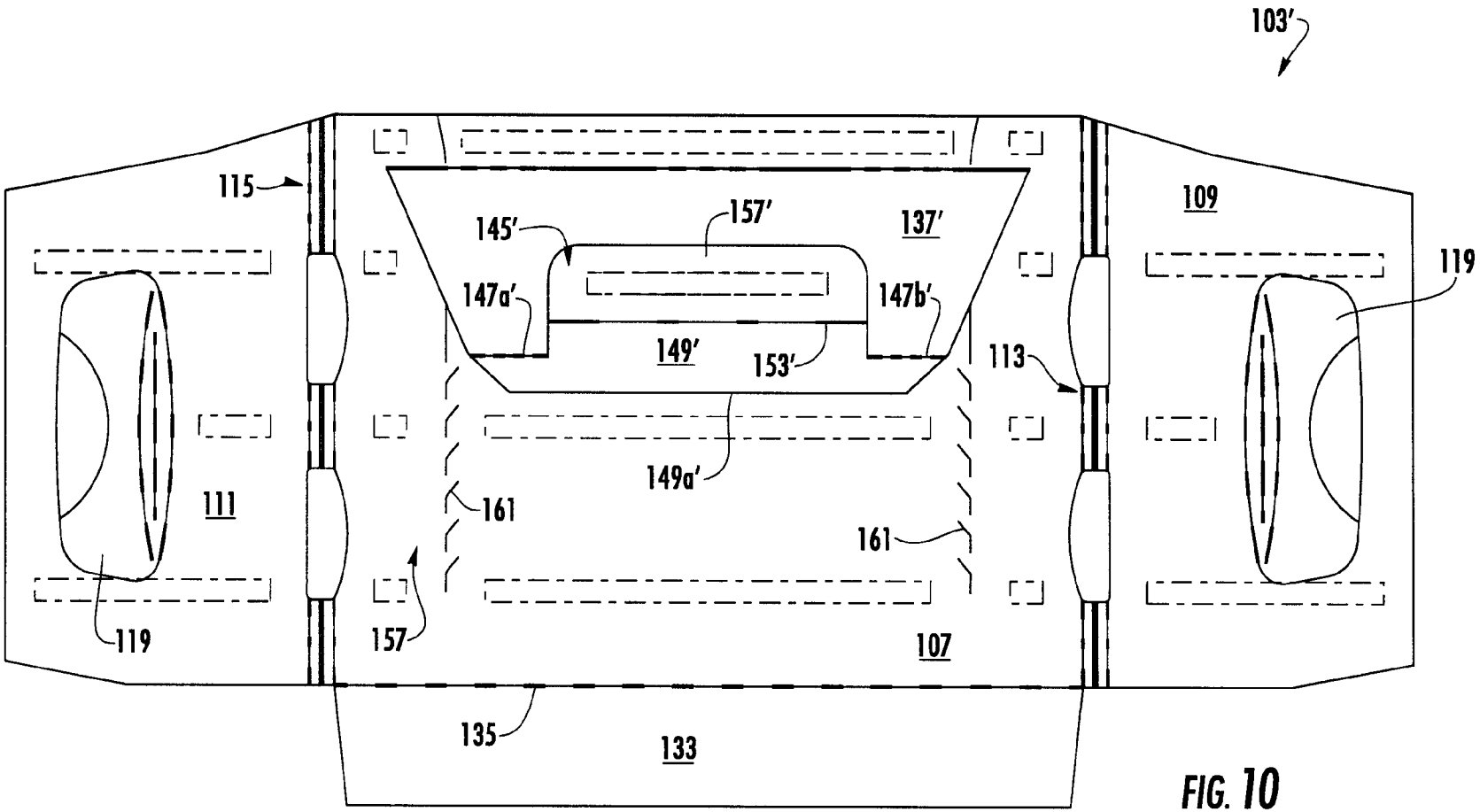
FIG. 10 is a plan view of an insert blank according to an alternative exemplary embodiment of the disclosure.

FIG. 10 is a plan view of an insert blank 103' for forming an insert (not shown) according to an alternative embodiment of the disclosure. The insert 103' is generally similar to the insert 103 of the first embodiment, except for variations noted and variations that will be apparent to one of ordinary skill in the art. Accordingly, similar or identical features of the embodiments have been given like or similar reference numbers. As shown in FIG. 10, the crown retention panel 137' is foldably connected to one attachment flap 145' along two spaced apart fold lines 147*a*', 147*b*'. The attachment flap 145' can include a distal portion 157' for being attached to a side panel of the outer carton (e.g., side panel 17 of the first embodiment) and a proximal portion 149' for extending generally horizontally between the crown retention panel 137' and the side panel of the outer carton. The proximal portion 149' can be foldably connected to the distal portion 157' along a fold line 153'. In one embodiment, the proximal portion 149' can form an edge 149*a'* that extends farther into the interior of the carton formed from the blanks (not shown) than the crown retention panel 137'. Accordingly, the proximal portion 149' and the edge 149*a'* can further restrain the containers C in the carton. In the illustrated embodiment, the fold lines 147*a*', 147*b'* can form a lowermost portion of the crown retention panel 137'. The insert blank 103' could be otherwise shaped, arranged, and/or configured without departing from the disclosure.

Figure 11:
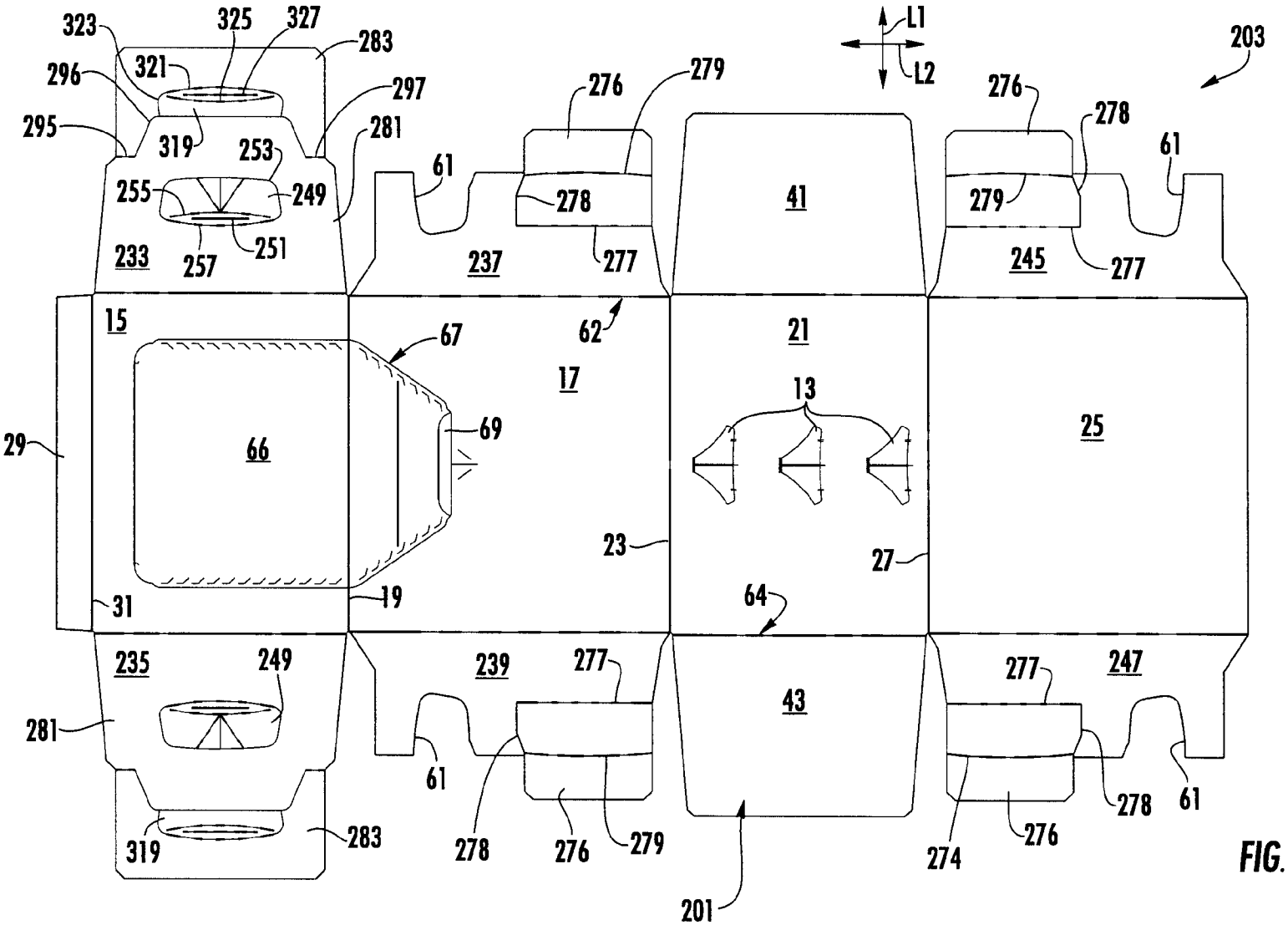
FIG. 11 is a plan view of a carton blank used to form a carton according to a second exemplary embodiment of the disclosure.
Figure 12:
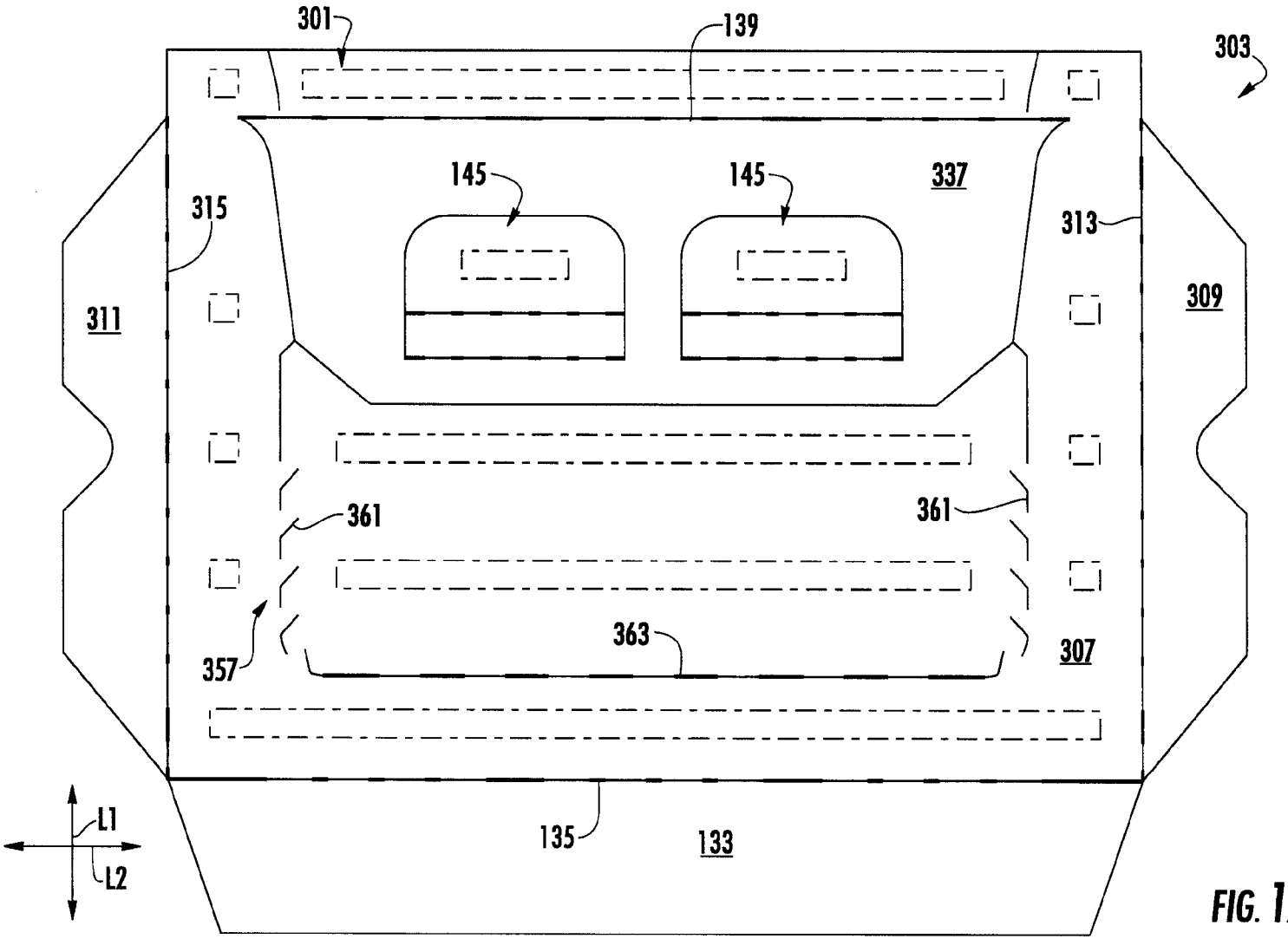
FIG. 12 is a plan view of an insert according to the second exemplary embodiment of the disclosure.
Figure 14:
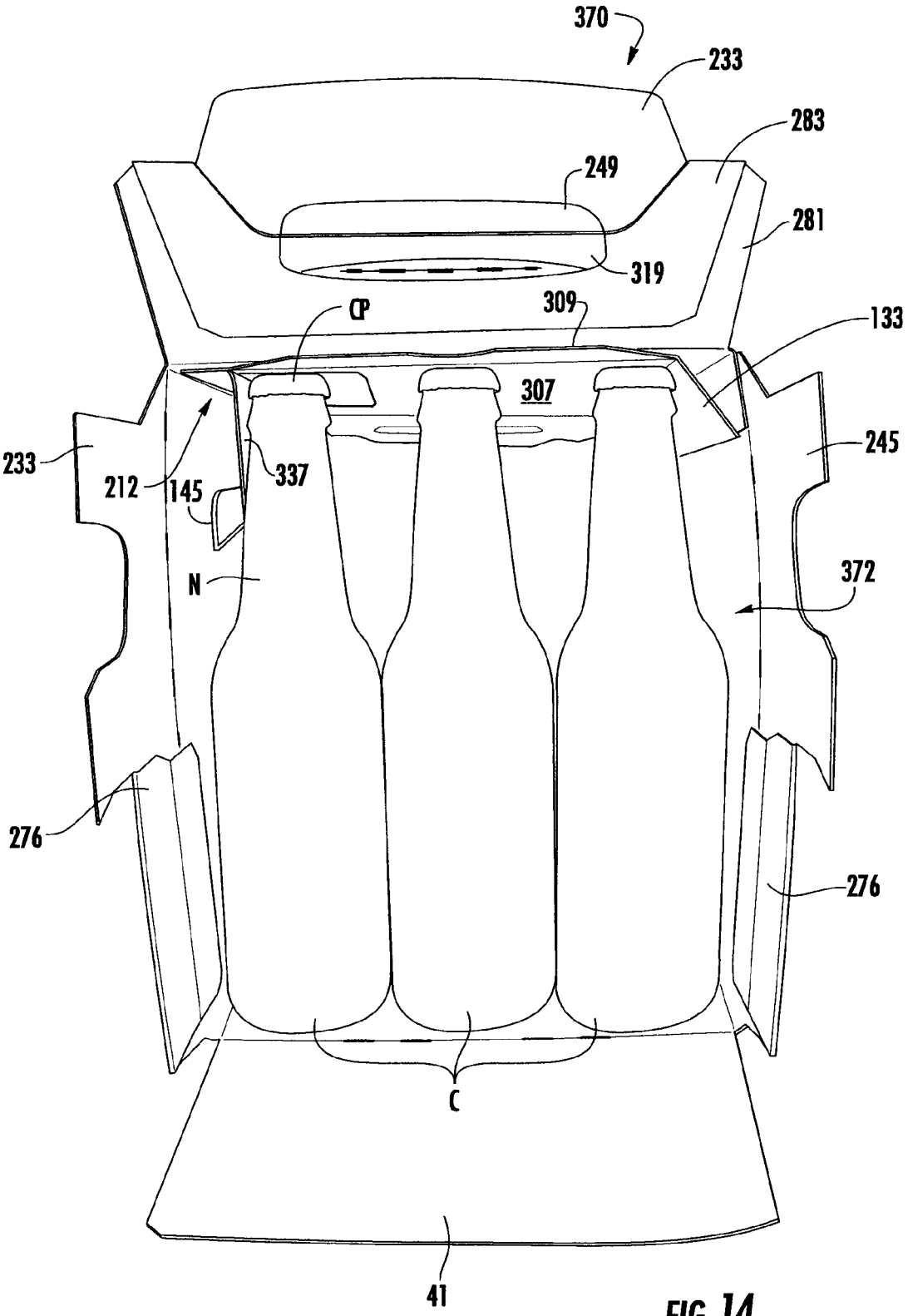
FIGS. 14 and 15 are perspective views of a partially-erected carton with containers loaded therein according to the second exemplary embodiment of the disclosure.
Figure 15:
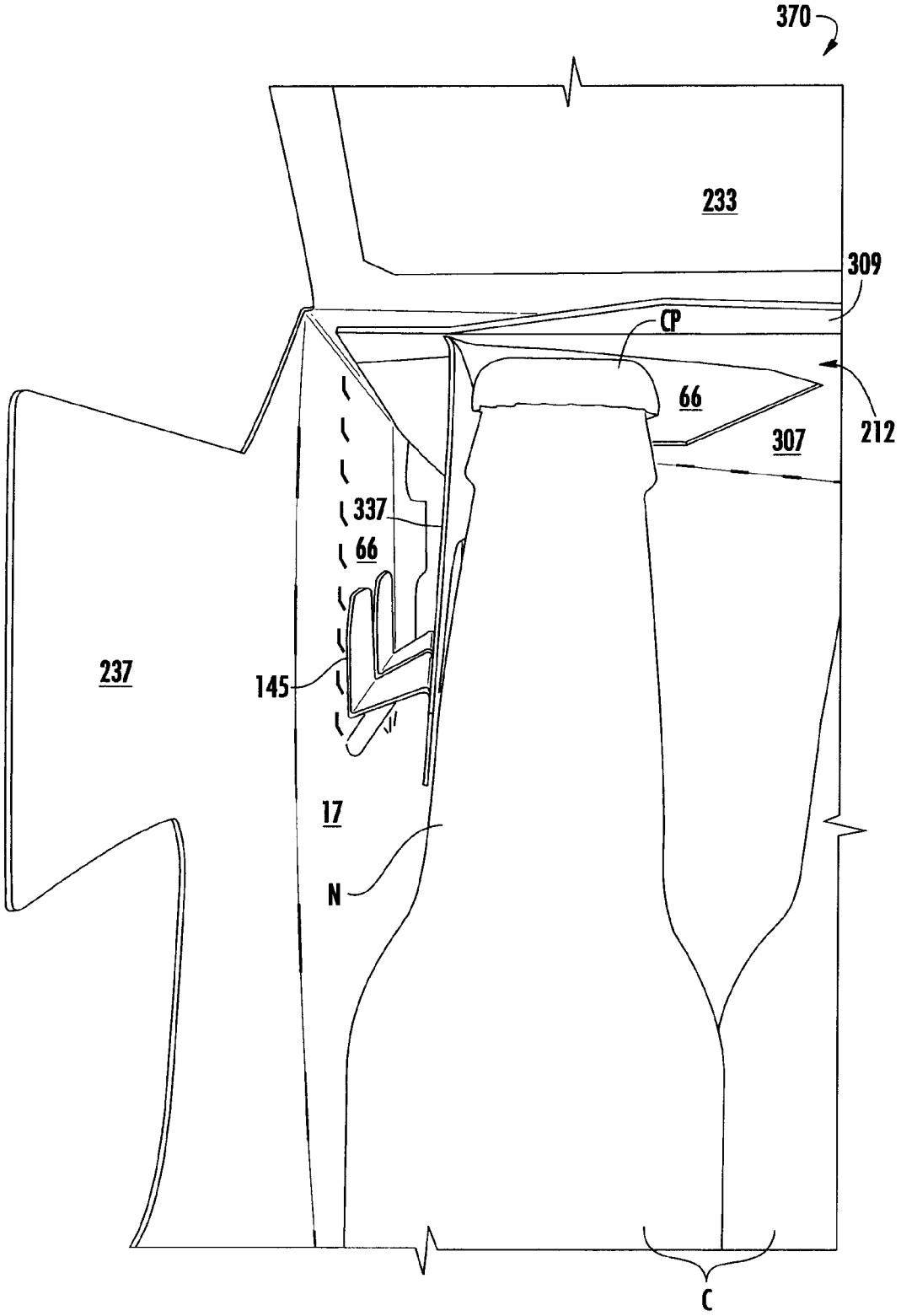

FIG. 11 is a plan view of an exterior surface 201 of a carton blank 203 for forming a carton 205 (FIG. 17) according to a second embodiment of the disclosure. FIG. 12 is a plan view of an exterior surface 301 of an insert blank 303 for forming an insert 212 (FIGS. 14-16) in the carton 205 according to the second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIG. 11, each of the top end flaps 233, 235 of the carton blank 203 includes a main panel 281 foldably connected to the top panel 15 along the respective longitudinal fold lines 62, 64 and a reinforcement flap 283 foldably connected to the main panel along spaced apart, longitudinal fold lines 295, 297. The reinforcement flap 283 can be separable from the main panel 281 along a tear or cut line 296. In one embodiment, when the carton 205 is formed, the reinforcement flaps 283 can be folded into face-to-face contact with the interior surface of the main panel 281 (FIG. 14). The reinforcement flap 283 can be similar or identical to those described in U.S. patent application Ser. No. 13/768,079, filed Feb. 15, 2013, the disclosure of which is hereby incorporated by reference for all purposes as if presented herein in its entirety.

Figure 16:
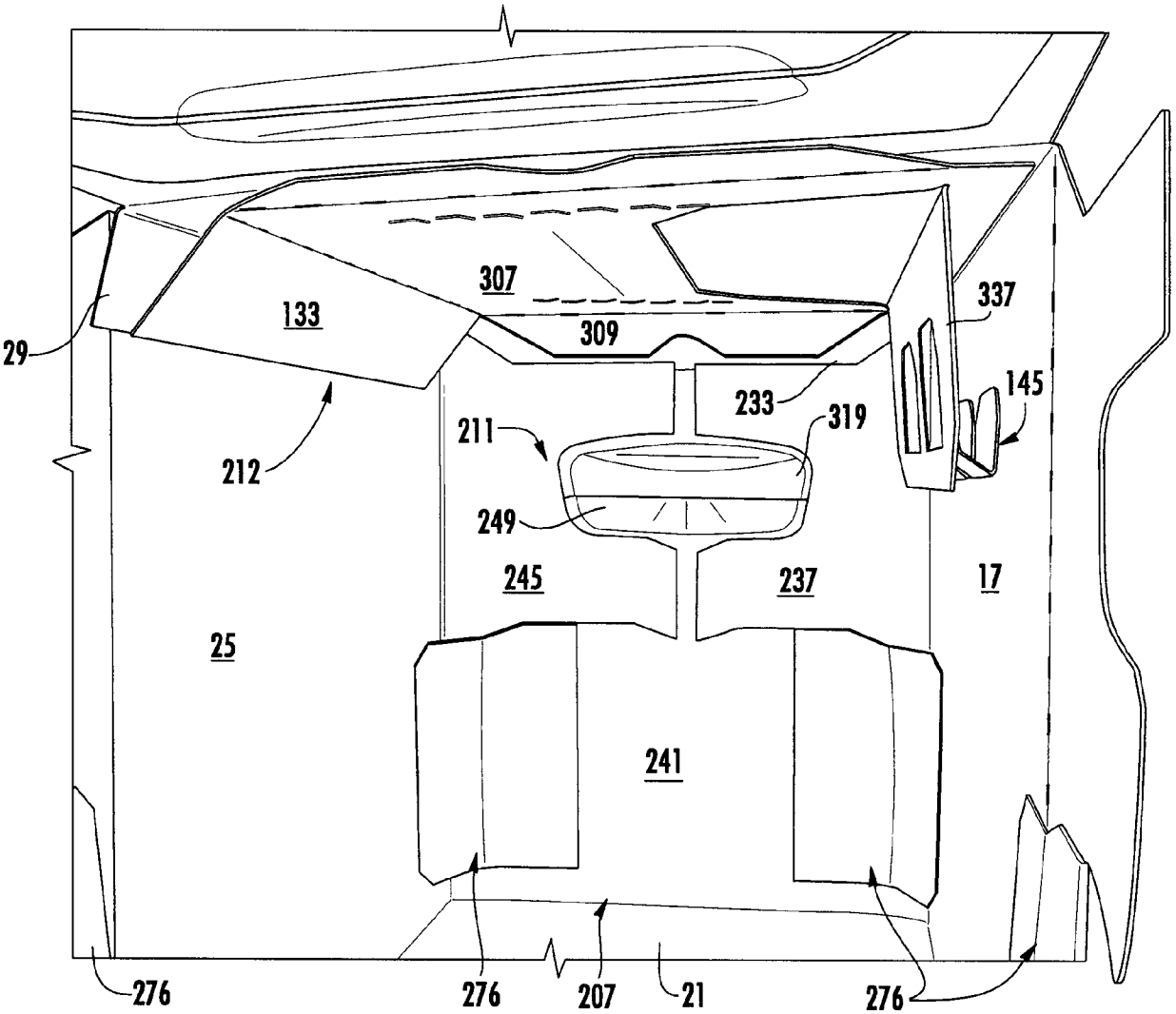
FIG. 16 is an interior perspective view of the partially-erected carton with a closed end according to the second exemplary embodiment of the disclosure.
Figure 17:
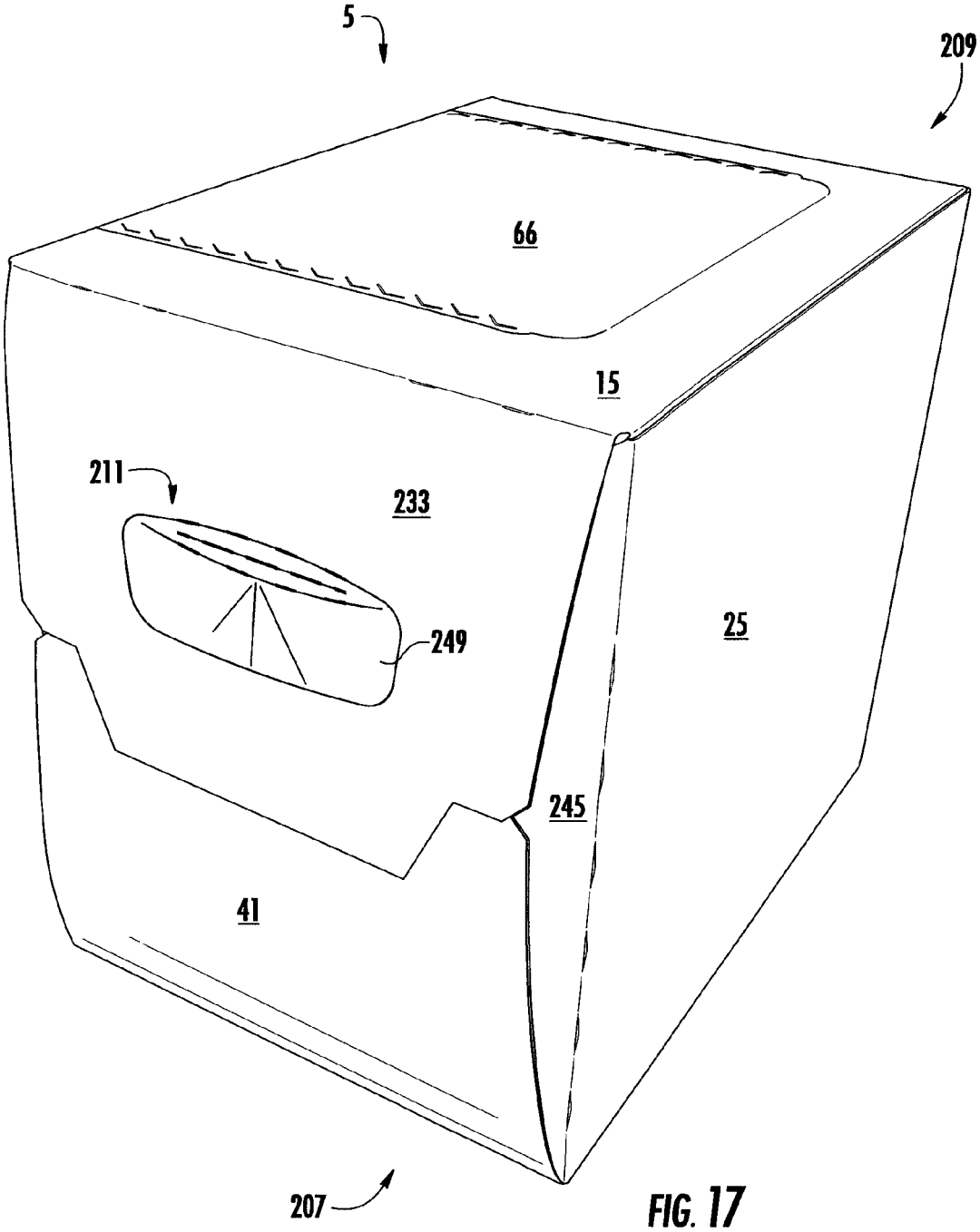
FIG. 17 is a perspective view of the erected carton according to the second exemplary embodiment of the disclosure.

In one embodiment, each of the reinforcement flaps 283 can include an inner handle flap 319 foldably attached to the respective reinforcement flap at a respective arcuate fold line 321. The inner handle flaps 319 are separable from the respective reinforcement flaps 283 along a respective cut or tear line 323. An opposing arcuate fold line 325 can extend in each of the inner handle flaps 319 adjacent or proximate the respective arcuate fold lines 321, and a longitudinal fold line 327 can extend between the opposing arcuate fold lines 321, 325 in each of the inner handle flaps. The inner handle flaps 319 and the fold lines 321, 325, 327, can be similar or identical to the respective outer handle flaps 249 and fold lines 251, 255, 257 so that the inner and outer handle flaps and fold lines are generally aligned and/or are overlapped with respect to one another in the handles 211 in the erected carton 205 (FIGS. 16 and 17). The inner handle flaps 319, the fold lines 321, 325, 327, the outer handle flaps 249, and/or the fold lines 251, 255, 257 could be otherwise shaped, arranged, and/or configured without departing from the disclosure.

As shown in FIG. 11, each of the side end flaps 237, 239, 245, 247 of the carton blank 203 can include a corner flap 276 foldably connected to the respective side end flaps along respective longitudinal fold lines 277 and separable from the respective side end flaps along respective tear or cut lines 278. Each of the corner flaps 276 can include a respective intermediate fold line 279. In one embodiment, the corner flaps 276 can help secure the containers C in the carton 205, help cushion the containers C, and/or help reinforce the respective corners of the carton. The corner flaps 276 can be similar or identical to those described in U.S. patent application Ser. No. 13/833,542, filed Mar. 15, 2013, the disclosure of which is hereby incorporated by reference for all purposes as if presented herein in its entirety.

The carton blank 203 could be otherwise shaped, arranged, and/or configured without departing from the disclosure.

Figure 13:
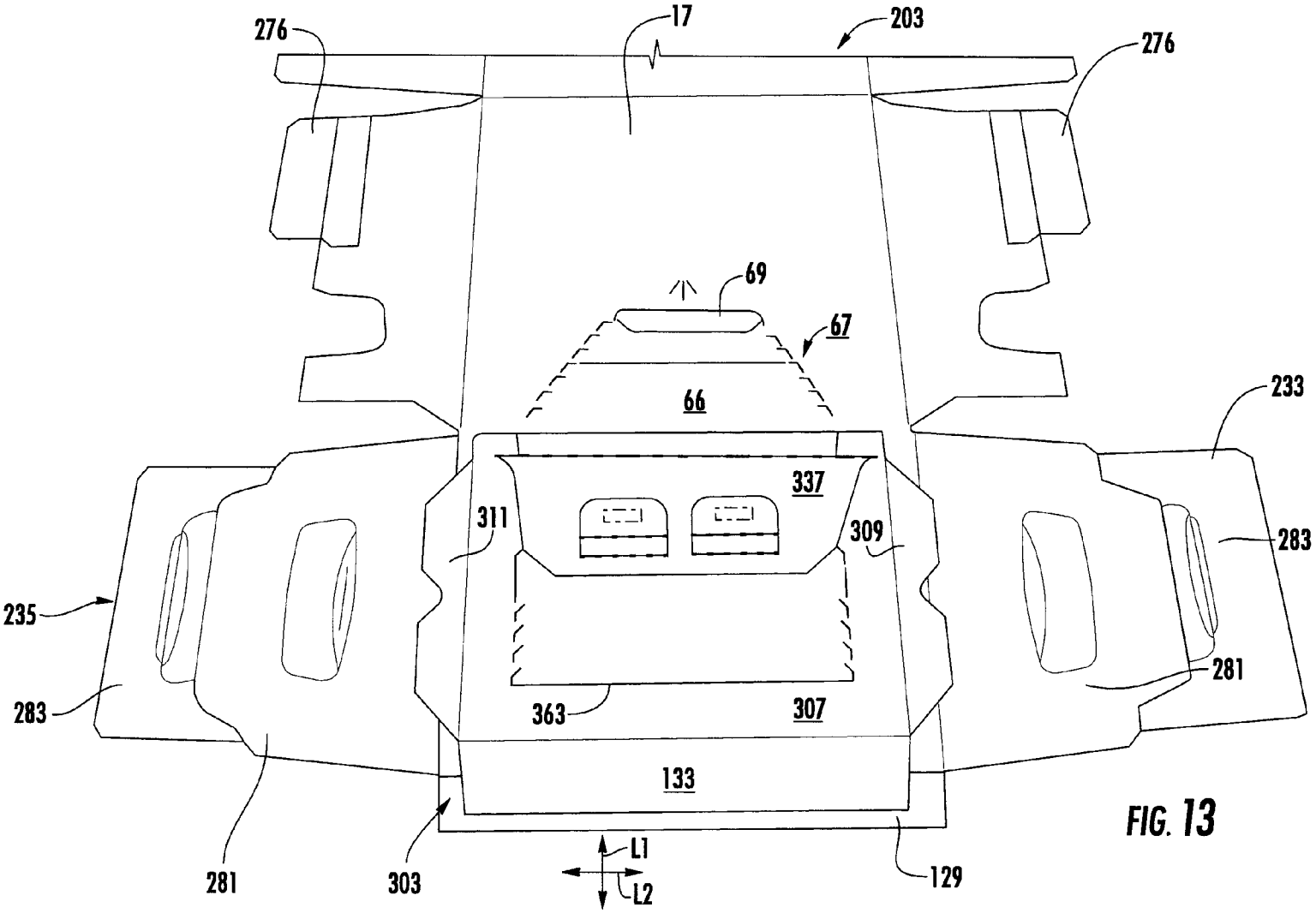
FIG. 13 is a plan view of the insert blank disposed on the carton blank according to the second exemplary embodiment of the disclosure.

As shown in FIG. 12, the insert blank 303 can be similar to the insert blank 103 of the first embodiment. The central panel 307 of the insert blank 303 includes a crown retention panel 337 with a slightly different shape than the crown retention panel 137 of the first embodiment. In an alternative embodiment, the crown retention panel could have any suitable shape without departing from the disclosure. The crown retention panel 337 is foldably connected to the central panel 307 and the two attachment flaps 145. The inner end flaps 309, 311 are smaller than the inner end flaps 109, 111 of the first embodiment and are configured to extend in an oblique direction in the carton 205 (FIG. 16). Accordingly, the central panel 307 is generally shorter than the top panel 15 in the lateral direction L2 so that the fold lines 313, 315 are spaced apart from the fold lines 62, 64 when the insert blank 303 is applied to the carton blank 203 (FIG. 13). As shown in FIG. 12, the inner dispenser pattern 357 can include a lateral fold line 363 extending between the tear lines 361. The insert blank 303 could be otherwise shaped, arranged, and/or configured without departing from the disclosure.

In the exemplary embodiment, the insert blank 303 can be applied to the carton blank 203 and the blanks can be formed into an open-ended sleeve 370 with an interior 372 as shown in FIGS. 13 and 14, for example. The containers C can be loaded into the sleeve and the end flaps can be overlapped with respect to one another to form the respective closed ends 207, 209 of the carton 205 with the respective handles 211 as shown in FIGS. 16 and 17, for example. The carton 205 could be formed by other steps without departing from the disclosure.

Figure 18:
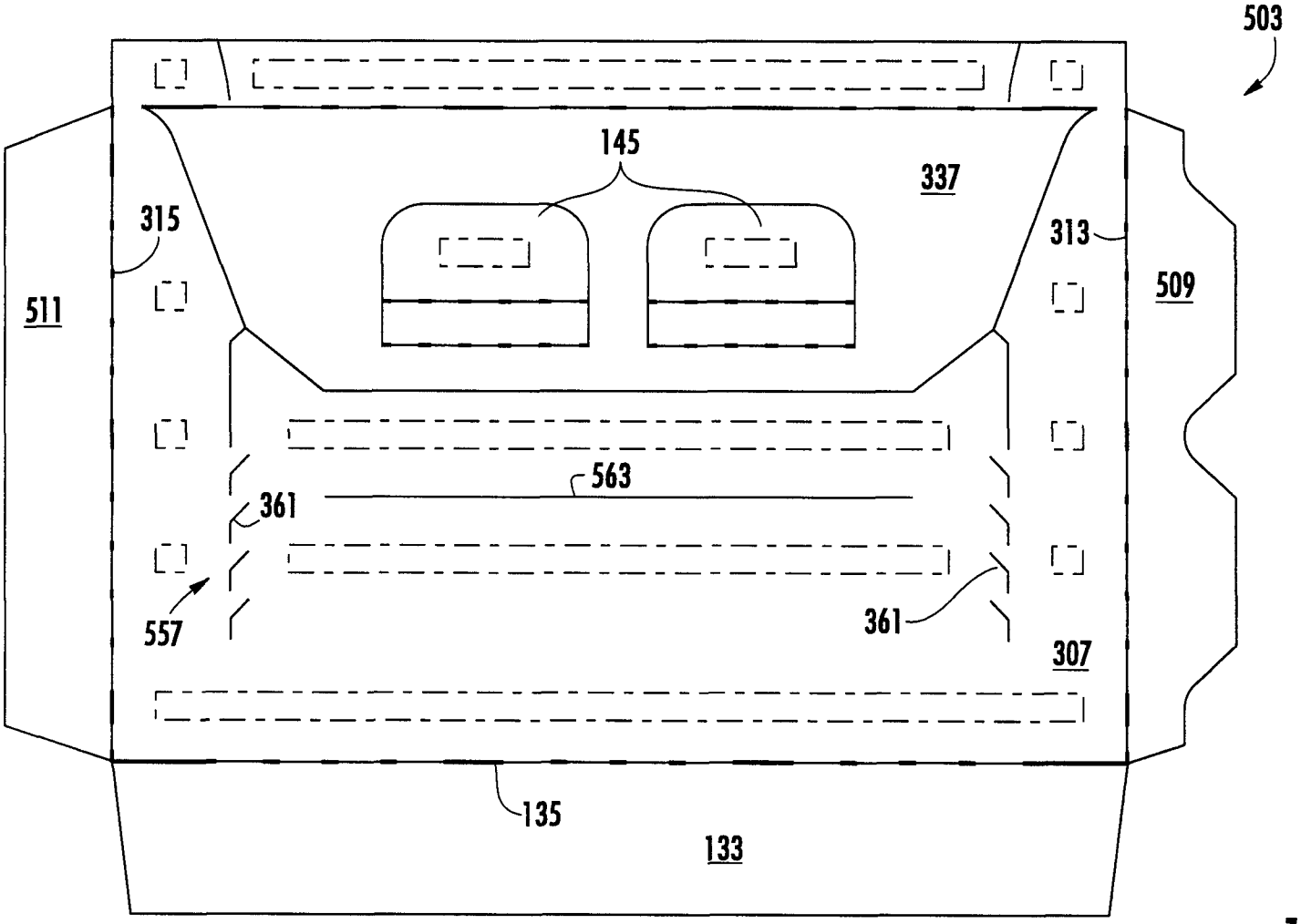
FIG. 18 is a plan view of an insert blank according to an alternative exemplary embodiment of the disclosure.

FIG. 18 is a plan view of an insert blank 503 for forming an insert (not shown) according to a third embodiment of the disclosure. The insert of the third embodiment is generally similar to the insert of the second embodiment, except for variations noted and variations that will be apparent to one of ordinary skill in the art. Accordingly, similar or identical features of the embodiments have been given like or similar reference numbers. As shown in FIG. 18, the inner end flaps 509, 511 have different shapes than the inner end flaps 309, 311. Additionally, the inner dispenser pattern 557 includes an intermediate cut 563 and the fold line 363 of the second embodiment is omitted. The insert blank 503 could be otherwise shaped, arranged, and/or configured without departing from the disclosure.

Any of the features of the various embodiments of the disclosure can be combined with, replaced by, or otherwise configured with other features of other embodiments of the disclosure without departing from the scope of this disclosure. Further, it is noted that the reinforcing inserts and insert blanks of the various embodiments can be incorporated into a carton having any carton style or panel configuration. The carton styles and panel configurations described above are included by way of example.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding a plurality of containers, the carton comprising:

a plurality of panels that extends at least partially around an interior of the carton, the plurality of panels comprises a top panel and a side panel; and an insert comprising a central panel and a crown retention panel foldably connected to the central panel along a fold line, an attachment flap being foldably connected to the crown retention panel;

wherein the top panel at least partially overlaps the central panel, at least a portion of the crown retention panel is spaced apart from the side panel in the interior of the carton, a portion of the central panel extends from the fold line toward the side panel so that a free edge of the central panel is disposed proximate the side panel, and at least a portion of the attachment flap is at least partially in face-to-face contact with the side panel.

2. The carton of claim 1, wherein the crown retention panel is positioned for contact with at least one container of the plurality of containers.

3. The carton of claim 1, wherein at least a portion of the crown retention panel is generally parallel to the side panel.

4. The carton of claim 1, wherein the attachment flap is a first attachment flap and the insert comprises a second attachment flap foldably connected to the crown retention panel.

5. A carton for holding a plurality of containers, the carton comprising:

a plurality of panels that extends at least partially around an interior of the carton, the plurality of panels comprises a top panel and a side panel; and an insert comprising a central panel and a crown retention panel foldably connected to the central panel, a first attachment flap and a second attachment flap each being foldably connected to the crown retention panel, wherein each of the first attachment flap and the second attachment flap comprises a proximal portion foldably connected to the crown retention panel along a first lateral fold line and a distal portion foldably connected to the proximal portion along a second lateral fold line;

wherein the top panel at least partially overlaps the central panel, at least a portion of the crown retention panel is spaced apart from the side panel in the interior of the carton, and at least a portion of the attachment flap is at least partially in face-to-face contact with the side panel.

6. The carton of claim 5, wherein the distal portions are at least partially attached in face-to-face contact to the side panel, and the proximal portions extend generally horizontally from the crown retention panel to the respective distal portions.

7. The carton of claim 1, wherein the attachment flap comprises a proximal portion foldably connected to the crown retention panel along a first lateral fold line and a distal portion foldably connected to the proximal portion along a second lateral fold line.

8. The carton of claim 7, wherein the first lateral fold line is spaced apart from an outer edge of the crown retention panel.

9. The carton of claim 8, wherein a portion of the outer edge of the crown retention panel comprises a lowermost edge of the crown retention panel.

10. The carton of claim 7, wherein the first lateral fold line comprises a lowermost portion of the crown retention panel.

11. The carton of claim 1, wherein the fold line is a lateral fold line and the free edge of the central panel is an outer free edge of the central panel, and the crown retention panel extends generally downwardly from the lateral fold line.

12. The carton of claim 1, further comprising a dispenser comprising an outer dispenser pattern and an inner dispenser pattern, wherein:

the outer dispenser pattern comprises an outer dispenser panel extending in at least the top panel and the side panel, outer the dispenser panel being at least partially defined by an outer tear line extending in at least the top panel and the side panel; and the inner dispenser pattern comprises an inner tear line extending in at least the central panel.

13. The carton of claim 12, wherein the outer dispenser panel is for being folded upwardly when the dispenser is actuated, and the attachment flap is at least partially attached to a portion of the outer dispenser panel in the side panel so that the attachment flap and the crown retention panel are folded upwardly with the outer dispenser panel when the dispenser is actuated.

14. The carton of claim 12, wherein at least a portion of the inner tear line extends from an interior edge of the central panel adjacent an opening in the central panel formed by the crown retention panel.

15. The carton of claim 12, wherein the inner tear line comprises a first inner tear line and the inner dispenser pattern comprises a second inner tear line, at least a portion of the central panel extending between the first inner tear line and the second inner tear line is at least partially attached to a portion of the outer dispenser panel in the top panel, the outer dispenser panel is for being folded upwardly when the dispenser is actuated, and the portion of the central panel is folded upwardly with the outer dispenser panel when the dispenser is actuated.

16. The carton of claim 1, wherein the side panel is a first side panel, the carton further comprises a second side panel, and the insert further comprises a side flap foldably connected to the central panel along a lateral fold line, the side flap extending generally downwardly and obliquely from the central panel towards the second side panel in the interior of the carton.

17. The carton of claim 1, further comprising a plurality of end flaps respectively foldably connected to respective panels of the plurality of panels, the plurality of end flaps being at least partially overlapped with respect to one another to thereby at least partially form a closed end of the carton, wherein the insert comprises an inner end flap foldably connected to the central panel proximate the closed end.

18. The carton of claim 17, wherein the inner end flap extends obliquely from the central panel to the closed end of the carton.

19. The carton of claim 17, wherein the plurality of end flaps comprises at least a top end flap foldably connected to the top panel, the top end flap at least partially overlaps the inner end flap, and the carton further comprises a handle formed in the closed end of the carton, the handle comprising an outer handle flap foldably connected to the top end flap and an inner handle flap foldably connected to the inner end flap, the outer handle flap at least partially overlapping the inner handle flap.

20. The carton of claim 1, wherein the central panel comprises an opening at least partially formed by the crown retention panel, the opening extending adjacent the fold line.

21. A carton for holding a plurality of containers, the carton comprising:

a plurality of panels that extends at least partially around an interior of the carton, the plurality of panels comprises a top panel and a side panel; and an insert comprising a central panel and a crown retention panel foldably connected to the central panel, an attachment flap being foldably connected to the crown retention panel, the attachment flap comprising a proximal portion foldably connected to the crown retention panel along a first lateral fold line and a distal portion foldably connected to the proximal portion along a second lateral fold line;

wherein the top panel at least partially overlaps the central panel, at least a portion of the crown retention panel is spaced apart from the side panel in the interior of the carton, at least the distal portion of the attachment flap is at least partially attached in face-to-face contact to the side panel, and the proximal portion extends generally horizontally from the crown retention panel to the distal portion.

22. A carton for holding a plurality of containers, the carton comprising:

a plurality of panels that extends at least partially around an interior of the carton, the plurality of panels comprises a top panel and a side panel;

an insert comprising a central panel and a crown retention panel foldably connected to the central panel along a lateral fold line, the lateral fold line being spaced apart from an outer free edge of the central panel, the crown retention panel extending generally downwardly from the lateral fold line, and an attachment flap being foldably connected to the crown retention panel; and a dispenser comprising an outer dispenser pattern in at least the top panel and an inner dispenser pattern in the central panel, the inner dispenser pattern comprising a first tear line and a second tear line, each of the first tear line and the second tear line comprising a first portion extending from the outer free edge of the central panel to the lateral fold line and a second portion extending from an interior edge of the central panel adjacent an opening in the central panel formed by the crown retention panel, wherein the top panel at least partially overlaps the central panel, at least a portion of the crown retention panel is spaced apart from the side panel in the interior of the carton, and at least a portion of the attachment flap is at least partially in face-to-face contact with the side panel.

23. In combination, a carton blank and an insert blank for forming a carton for holding a plurality of containers:

the carton blank comprising a plurality of panels comprising a top panel and a side panel; and the insert blank comprising a central panel and a crown retention panel foldably connected to the central panel along a fold line, a portion of the central panel extending from the fold line toward the side panel so that a free edge of the central panel is disposed proximate the side panel, the crown retention panel being at least partially separable from the central panel along a cut line, and an attachment flap being foldably connected to the crown retention panel;

wherein the top panel at least partially overlaps the central panel, at least a portion of the crown retention panel is for being disposed in a position that is spaced apart from the side panel when the carton is formed from the carton blank and the insert blank, and at least a portion of the attachment flap is for being disposed at least partially in face-to-face contact with the side panel when the carton is formed from the carton blank and the insert blank.

24. The combination of claim 23, wherein the crown retention panel is for being positioned for contact with at least one container of the plurality of containers when the carton is formed from the carton blank and the insert blank.

25. The combination of claim 23, wherein at least a portion of the crown retention panel is in face-to-face contact with the top panel.

26. The combination of claim 23, wherein the attachment flap is a first attachment flap and the insert comprises a second attachment flap foldably connected to the crown retention panel.

27. The combination of claim 23, wherein the attachment flap comprises a proximal portion foldably connected to the crown retention panel along a first lateral fold line and a distal portion foldably connected to the proximal portion along a second lateral fold line.

28. The combination of claim 27, wherein the attachment flap is at least partially separable from the crown retention panel along a U-shaped cut line.

29. The combination of claim 27, wherein the first lateral fold line is spaced apart from the cut line.

30. The combination of claim 27, wherein the cut line is a first cut line, at least a portion of the proximal portion of the attachment flap is separable from the central panel along the first cut line, and at least a portion of the distal portion of the attachment flap is separable from the crown retention panel along a second cut line.

31. The combination of claim 23, wherein the fold line is a lateral fold line, and the cut line extends away from the free edge of the central panel.

32. The combination of claim 23, further comprising a dispenser comprising an outer dispenser pattern and an inner dispenser pattern, wherein:

the outer dispenser pattern comprises an outer dispenser panel extending in at least the top panel and the side panel, outer the dispenser panel being at least partially defined by an outer tear line extending in at least the top panel and the side panel; and the inner dispenser pattern comprises an inner tear line extending in at least the central panel.

33. The combination of claim 32, wherein the inner tear line comprises a first inner tear line and the inner dispenser pattern comprises a second inner tear line, at least a portion of the central panel extending between the first inner tear line and the second inner tear line is at least partially attached to a portion of the outer dispenser panel in the top panel.

34. The combination of claim 23, wherein the side panel is a first side panel, the blank further comprises a second side panel, and the insert further comprises a side flap foldably connected to the central panel along a lateral fold line, the side flap being for extending generally downwardly and obliquely from the central panel towards the second side panel in the carton forming from the carton blank and the insert blank.

35. The combination of claim 23, further comprising a plurality of end flaps respectively foldably connected to respective panels of the plurality of panels, the plurality of end flaps comprises a top end flap foldably connected to the top panel, wherein the insert comprises an inner end flap foldably connected to the central panel proximate the top end flap.

36. The combination of claim 35, wherein the top end flap at least partially overlaps the inner end flap, and the blank further comprises a handle formed in the closed end of the carton, the handle comprising an outer handle flap foldably connected to the top end flap and an inner handle flap foldably connected to the inner end flap, the outer handle flap at least partially overlapping the inner handle flap.

37. In combination, a carton blank and an insert blank for forming a carton for holding a plurality of containers:

the carton blank comprising a plurality of panels comprising a top panel and a side panel; and the insert blank comprising a central panel and a crown retention panel foldably connected to the central panel, a first attachment flap and a second attachment flap each being foldably connected to the crown retention panel, wherein each of the first attachment flap and the second attachment flap comprises a proximal portion foldably connected to the crown retention panel along a first lateral fold line and a distal portion foldably connected to the proximal portion along a second lateral fold line;

wherein the top panel at least partially overlaps the central panel, at least a portion of the crown retention panel is for being disposed in a position that is spaced apart from the side panel when the carton is formed from the carton blank and the insert blank, and at least a portion of the attachment flap is for being disposed at least partially in face-to-face contact with the side panel when the carton is formed from the carton blank and the insert blank.

38. In combination, a carton blank and an insert blank for forming a carton for holding a plurality of containers:

the carton blank comprising a plurality of panels comprising a top panel and a side panel;

the insert blank comprising a central panel and a crown retention panel foldably connected to the central panel along a lateral fold line, the lateral fold line being spaced apart from an outer free edge of the central panel, at least a portion of the crown retention panel being separable from the central panel along a cut line that extends away from the outer free edge of the central panel, and an attachment flap being foldably connected to the crown retention panel; and a dispenser comprising an outer dispenser pattern in at least the top panel and an inner dispenser pattern in the central panel, the inner dispenser pattern comprising a first tear line and a second tear line, each of the first tear line and the second tear line comprising a first portion extending from the outer free edge of the central panel to the lateral fold line and a second portion extending from the cut line;

wherein the top panel at least partially overlaps the central panel, at least a portion of the crown retention panel is for being disposed in a position that is spaced apart from the side panel when the carton is formed from the carton blank and the insert blank, and at least a portion of the attachment flap is for being disposed at least partially in face-to-face contact with the side panel when the carton is formed from the carton blank and the insert blank.

39. A method of forming a carton for holding a plurality of containers, the method comprising:

obtaining a carton blank comprising a plurality of panels comprising a top panel and a side panel;

obtaining an insert blank comprising a central panel and a crown retention panel foldably connected to the central panel along a fold line, the crown retention panel being at least partially separable from the central panel along a cut line, and an attachment flap being foldably connected to the crown retention panel;

positioning the insert blank relative to the carton blank so that the top panel at least partially overlaps the central panel and so that a portion of the central panel extends from the fold line toward the side panel and a free edge of the central panel is disposed proximate the side panel;

folding the top panel relative to the side panel so that the central panel at least partially overlaps the side panel and the attachment flap is at least partially in face-to-face contact with the side panel; and forming an interior of the carton at least partially defined by the plurality of panels, the forming the interior of the carton comprising forming an open-ended sleeve, and the forming the interior of the carton causing the crown retention panel to fold relative to the central panel and to be disposed in a position that is spaced apart from the side panel in the interior of the carton.

40. The method of claim 39, further comprising loading the plurality of containers into the interior of the carton, at least one of the containers of the plurality of containers contacting the crown retention panel.

41. The method of claim 39, wherein the crown retention panel is at least partially in face-to-face contact with the top panel, and the folding the top panel relative to the side panel comprises positioning the crown retention panel in face-to-face contact with the side panel.

42. The method of claim 39, further comprising attaching at least a portion of the attachment flap to the side panel after the folding the top panel relative to the side panel.

43. The method of claim 39, wherein the attachment flap comprises a proximal portion foldably connected to the crown retention panel and a distal portion foldably connected to the proximal portion, the distal portion is at least partially attached to the side panel, and the forming the interior of the carton causes the proximal portion to fold relative to the distal portion to extend between the distal portion and the crown retention panel as the crown retention panel is folded relative to the top panel in the interior of the carton.

44. The method of claim 39, wherein the fold line is a lateral fold line, and the cut line extends away from the free edge of the central panel, the forming the interior of the carton causing the crown retention panel to at least partially separate from the central panel along the cut line as the crown retention panel is folded relative to the top panel.

* * * * *